US008835084B2

(12) United States Patent
Nagai et al.

(10) Patent No.: US 8,835,084 B2
(45) Date of Patent: Sep. 16, 2014

(54) ELECTROPHOTOGRAPHIC PHOTORECEPTOR, AND IMAGE FORMING METHOD, IMAGE FORMING APPARATUS AND PROCESS CARTRIDGE USING SAME

(75) Inventors: Kazukiyo Nagai, Shizuoka (JP); Tetsuro Suzuki, Shizuoka (JP); Hongguo Li, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 97 days.

(21) Appl. No.: 13/239,880

(22) Filed: Sep. 22, 2011

(65) Prior Publication Data

US 2012/0087695 A1 Apr. 12, 2012

(30) Foreign Application Priority Data

Oct. 8, 2010 (JP) ..... 2010-228060

(51) Int. Cl.

| | |
|---|---|
| ***G03G 5/047*** | (2006.01) |
| ***G03G 5/147*** | (2006.01) |
| ***G03G 5/07*** | (2006.01) |
| ***G03G 5/06*** | (2006.01) |

(52) U.S. Cl.

CPC ..... *G03G 5/047* (2013.01); *G03G 5/14795* (2013.01); *G03G 5/14791* (2013.01); *G03G 5/1473* (2013.01); *G03G 5/071* (2013.01); *G03G 5/14786* (2013.01); *G03G 5/0668* (2013.01); *G03G 2215/00957* (2013.01); *G03G 5/0672* (2013.01)

USPC ..... 430/58.35; 430/66; 430/123.42

(58) Field of Classification Search

CPC ... G03G 5/0605; G03G 5/0612; G03G 5/071; G03G 5/1473; G03G 5/14786; G03G 5/0672; G03G 5/0668; G03G 5/672; G03G 5/668

USPC ..... 430/58.35, 58.05, 58.7, 66, 70, 71, 72, 430/123.42; 399/116, 159

See application file for complete search history.

(56) References Cited

U.S. PATENT DOCUMENTS

| | | | | |
|---|---|---|---|---|
| 4,363,859 | A * | 12/1982 | Sasaki et al. | 430/58.6 |
| 7,175,957 | B2 | 2/2007 | Suzuki et al. | |
| 7,179,573 | B2 | 2/2007 | Suzuki et al. | |
| 7,361,438 | B2 | 4/2008 | Suzuki et al. | |
| 7,399,563 | B2 | 7/2008 | Suzuki et al. | |
| 2005/0287452 | A1 * | 12/2005 | Tamura et al. | 430/58.7 |
| 2010/0330475 | A1 * | 12/2010 | Tamoto et al. | 430/56 |

FOREIGN PATENT DOCUMENTS

| | | |
|---|---|---|
| JP | 56-029245 A * | 3/1981 |
| JP | 2000-66425 | 3/2000 |
| JP | 4145820 | 9/2008 |
| JP | 4266859 | 5/2009 |
| JP | 4420397 | 2/2010 |
| JP | 4491261 | 6/2010 |

OTHER PUBLICATIONS

USPTO English-language translation of Japanese Patent 56-029245 A (pub. Mar. 1981).*

U.S. Appl. No. 13/156,750, filed Jun. 9, 2011, Li, et al.

* cited by examiner

*Primary Examiner* — Janis L Dote

(74) *Attorney, Agent, or Firm* — Oblon, Spivak, McClelland, Maier & Neustadt, L.L.P.

(57) ABSTRACT

An electrophotographic photoreceptor including an electroconductive substrate, a charge generation layer located overlying the electroconductive substrate, a hole transport layer located on the charge generation layer, and a hole transport protective layer located on the hole transport layer. The hole transport protective layer includes a three-dimensionally crosslinked material obtained by irradiating a composition including at least a radically polymerizable hole transport compound with ultraviolet rays or electron beams so that the radically polymerizable hole transport compound causes chain polymerization. In addition, the protective layer includes a specific cyano-containing styryl aromatic compound or a specific cyano-containing distyryl aromatic compound.

4 Claims, 5 Drawing Sheets

ELECTROPHOTOGRAPHIC PHOTORECEPTOR, AND IMAGE FORMING METHOD, IMAGE FORMING APPARATUS AND PROCESS CARTRIDGE USING SAME

CROSS-REFERENCE TO RELATED APPLICATIONS

This patent application is based on and claims priority pursuant to 35 U.S.C. §119 to Japanese Patent Application No. 2010-228060, filed on Oct. 8, 2010, in the Japan Patent Office, the entire disclosure of which is hereby incorporated herein by reference.

FIELD OF THE INVENTION

The present invention relates to an electrophotographic photoreceptor, and to an image forming method, an image forming apparatus and a process cartridge using the electrophotographic photoreceptor.

BACKGROUND OF THE INVENTION

Electrophotographic image forming apparatuses have been used for offices. Because of being able to easily perform on-demand image formation, electrophotographic image forming apparatuses are recently used for commercial printing. The electrophotographic image forming apparatuses for use in commercial printing are required to fulfill the following requirements 1-5:

1. Higher speed printing;
2. Larger quantity printing;
3. Higher image qualities;
4. Image formability on various kinds of recording materials; and
5. Lower running costs.

In order to fulfill the requirements 1, 2 and 5, it is necessary to prolong the life of photoreceptors, which are main devices of such electrophotographic image forming apparatus. Photoreceptors are broadly classified into inorganic photoreceptors typified by photoreceptors using amorphous silicon, and organic photoreceptors typified by photoreceptors using an organic charge generation material and an organic charge transport material. Organic photoreceptors have the following advantages over inorganic photoreceptors:

1. Good optical properties such as wide light absorption range, and large absorbance;
2. Good electric properties such as high sensitivity and good charge stability;
3. Wide material selectivity;
4. Good productivity;
5. Low costs; and
6. Little toxicity.

However, organic photoreceptors have the following disadvantages:

1. The scratch resistance is poor, thereby easily forming defective images; and
2. The abrasion resistance is poor, thereby easily causing deterioration of sensitivity and charging ability, and leak of charges, resulting in formation of abnormal images such as low density images and images with background fouling.

In attempting to improve the scratch resistance and the abrasion resistance, several photoreceptors have been proposed in which a layer having a good mechanical strength is formed as an outermost layer of a conventional organic photoreceptor.

For example, a photoreceptor is proposed which has a photosensitive layer including a crosslinked material obtained by crosslinking a positive hole transport compound having two or more chain polymerizable groups in a molecule. In addition, photoreceptors have been proposed in which a protective layer obtained by irradiating a composition, which includes a radically polymerizable charge transport compound, a tri- or more-functional radically polymerizable monomer, and a photo-polymerization initiator, with ultraviolet rays to crosslink the composition. These photoreceptors have good scratch resistance and abrasion resistance while exhibiting high stability to withstand environmental conditions. Therefore, high quality images can be produced without using a drum heater to heat the photoreceptors to reduce the moisture content of the photoreceptors.

Further, a photoreceptor is proposed in which an ultraviolet absorbent is included in a protective layer, which is formed on a photosensitive layer by forming a layer and irradiating the layer with ultraviolet rays to crosslink the layer, to prevent the electric properties of the photosensitive layer from being deteriorated by the ultraviolet rays.

It can be understood from these proposals that by forming a three dimensionally crosslinked protective layer on a photoreceptor by crosslinking a radically polymerizable charge transport material (particularly charge transport material having an acrylic group) together with an optional acrylic monomer, a good combination of scratch resistance, abrasion resistance and electric properties can be imparted to the photoreceptor. Therefore, such a photoreceptor may be used for commercial printing. However, in commercial printing, the requirements for image qualities become severer and severer recently. Therefore, it is necessary for a photoreceptor used for commercial printing to reduce variation in potential after repeated use (hereinafter this variation is sometimes referred to as potential variation with time) and variation in potential from place to place on the surface of the charged photoreceptor (hereinafter this variation is sometimes referred to as in-plane potential variation). The above-mentioned photoreceptors are not satisfactory with respect to this point.

The reason therefor is considered to be as follows. Specifically, in order to form a protective layer having a high cross-linkage density by performing a radical polymerization reaction, a method in which a coating liquid including such a radically polymerizable charge transport compound and a photo-decomposable radical polymerization initiator is applied, followed by irradiation of light (ultraviolet rays), or a method in which a coating liquid including such a radically polymerizable charge transport compound is applied, followed by irradiation of electron beams or radiation beams to directly excite an acrylic group of the compound is used. In any of these methods, the charge transport material in the protective layer is excited and thereby part of the compound is decomposed, resulting in deterioration of the charge transport property of the photoreceptor.

In attempting to solve the problem, there is a proposal in that an ultraviolet absorbent is included in the protective layer. However, addition of an ultraviolet absorbent to a protective layer deteriorates the charge transport property of the photoreceptor, and inhibits a radical polymerization reaction, thereby making it impossible to form a protective layer having a high cross-linkage density. In addition, there is a singlet oxygen quencher (such as nickel dithiorate complexes), which can inhibit decomposition of a dye. Addition of such a quencher to a protective layer perfectly deteriorates the photosensitivity of the photoreceptor.

Thus, there is no photoreceptor which has a crosslinked protective layer obtained by crosslinking a radically polymerizable charge transport compound using ultraviolet rays and which can produce high quality images (i.e., little image density variation with time and little in-plane image density variation) so as to be used for commercial printing use.

For these reasons, the inventors recognized that there is a need for a photoreceptor which has a protective layer having a good combination of charge transport property, scratch resistance, and abrasion resistance and which can produce higher quality images than ever.

BRIEF SUMMARY OF THE INVENTION

As an aspect of the present invention, an electrophotographic photoreceptor is provided which includes an electroconductive substrate, a charge generation layer located overlying the electroconductive substrate, a hole transport layer located on the charge generation layer, and a hole transport protective layer located on the hole transport layer. The hole transport protective layer includes an ultraviolet (UV) or electron beam (EB) crosslinked material including a unit obtained from a radically polymerizable hole transport compound. The protective layer further includes a cyano compound having the following formula (1) or (2).

FORMULA (1)

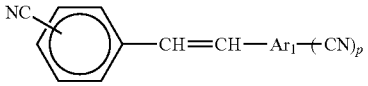

wherein $Ar_1$ represents a mono- or di-valent benzene ring or a mono- or di-valent condensed polycyclic hydrocarbon group having 10 to 14 carbon atoms; and p is 0 or 1.

FORMULA (2)

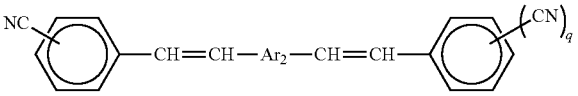

wherein $Ar_2$ represents a mono- or di-valent benzene ring or a mono- or di-valent condensed polycyclic hydrocarbon group having 10 to 14 carbon atoms; and q is 0 or 1.

In this regard, "overlying" can include direct contact and allow for one or more intermediate layers.

As another aspect of the present invention, an image forming method is provided which includes charging the above-mentioned photoreceptor; irradiating the charged photoreceptor with light to form an electrostatic latent image on a surface of the photoreceptor; developing the electrostatic latent image with a developer including a toner to form a toner image on the surface of the photoreceptor; and transferring the toner image onto a recording material.

As yet another aspect of the present invention, an image forming apparatus is provided which includes the above-mentioned photoreceptor serving as an image bearer; a charger to charge a surface of the photoreceptor; an irradiator to irradiate the charged photoreceptor with light to form an electrostatic latent image on the surface of the photoreceptor; a developing device to develop the electrostatic latent image with a developer including a toner to form a toner image on the surface of the photoreceptor; and a transferring device to transfer the toner image onto a recording material.

As a further aspect of the present invention, a process cartridge is provided which includes the above-mentioned photoreceptor; and at least one of a charger to charge a surface of the photoreceptor, a developing device to develop an electrostatic latent image on the surface of the photoreceptor with a developer including a toner to form a toner image thereon, a transferring device to transfer the toner image onto a recording material, a cleaner to clean the surface of the photoreceptor after the toner image is transferred, and a discharger to decay residual charges on the surface of the photoreceptor after the toner image is transferred. The photoreceptor and the at least one of the charger, the developing device, the transferring device and the cleaner are integrated into a single unit so as to be detachably attachable to an image forming apparatus.

The aforementioned and other aspects, features and advantages will become apparent upon consideration of the following description of the preferred embodiments taken in conjunction with the accompanying drawings.

DETAILED DESCRIPTION OF THE INVENTION

Figure 1:
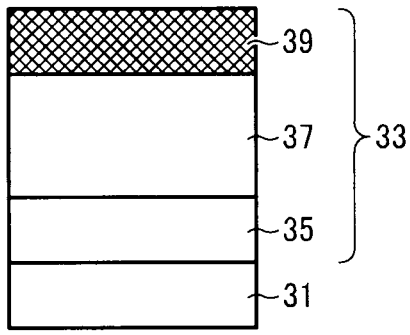
FIG. 1 is a schematic view illustrating the cross-section of an example of the photoreceptor of the present invention.

The present inventors have investigated various materials to discover an additive for a protective layer, which can inhibit decomposition of a charge transport material included in the protective layer and formation of charge traps, which are caused by the decomposition and deteriorate charge transferability of the protective layer, without preventing radical chain polymerization of a radically polymerizable charge transport compound and which does not adversely affect basic functions of the photoreceptor such as charging property and photosensitivity. As a result of the investigation, it is discovered that specific cyano compound can satisfy these requirements.

Specifically, the photoreceptor of the present invention has a structure such that a three-dimensionally crosslinked protective layer is formed on a layered photosensitive layer, and the protective layer includes an UV or EB crosslinked material formed by irradiating a composition including a radically polymerizable hole transport compound and a poly-functional radically polymerizable monomer with high energy rays such as ultraviolet rays (UV) and electron beams (EB) to radically polymerize the composition, and a specific cyano compound. By including a specific cyano compound in the protective layer, the number of charge traps formed in the protective layer can be reduced while reducing unevenness of distribution of charge traps in the protective layer, thereby avoiding potential variation with time and in-plane photo-decayed potential variation, resulting in formation of images with little image density variation even when the photoreceptor is repeatedly used. Therefore, the photoreceptor can be preferably used for commercial printing.

In order that a photoreceptor can produce such high quality images as to be used for commercial printing, it is preferable for the photoreceptor to have good potential evenness such that potential is even at any positions of the charged photoreceptor, and little potential variation such that the potentials (dark potential and photo-decayed potential) of the photoreceptor hardly vary even when multiple images are continuously produced. In order to satisfy these requirements, it is important that the protective layer has good evenness in terms of thickness and composition, and the number of charge traps in the protective layer is reduced while reducing uneven distribution of charge traps therein.

Even when a uniform film of a protective layer is formed on a photosensitive layer while preventing the constituent materials of the photosensitive layer from migrating into the protective layer, exposure of high energy rays applied to crosslink the protective layer varies due to variation of conditions of the irradiator and the like. Specifically, when an irradiator having multiple ultraviolet lamps irradiates a coated protective layer including a photo-polymerization initiator, the exposure of ultraviolet rays applied to the protective layer varies from place to place due to overlapping of the irradiating ranges of the multiple lamps and reflections of ultraviolet rays in the irradiator, thereby affecting the thickness and composition evenness of the protective layer.

Since the variation of exposure of ultraviolet rays is considered to cause variation of cross-linkage density of the protective layer, the present inventors made an experiment in which the exposure of ultraviolet rays increases to an extent such that even portions having relatively small exposure of ultraviolet rays can be perfectly crosslinked, but a good effect could not be produced while deteriorating the properties of the photoreceptor. Therefore, it is considered that uneven exposure of ultraviolet rays causes uneven decomposition of the radically polymerizable charge transport compound used for forming the protective layer, and it is important to inhibit photo-decomposition of the radically polymerizable charge transport compound used for the protective layer in order to maintain a good combination of potential variation with time and in-plane potential variation.

As a result of the present inventors' experiments to discover an additive for a protective layer, which can prevent photo-decomposition of a radically polymerizable charge transport compound and which does not inhibit a crosslinking reaction of the compound when the compound is exposed to ultraviolet rays, it is discovered that specific cyano compounds are effective. The mechanism of the action of the cyano compounds is not yet determined, but is considered as follows. Specifically, when energy is transferred from a radically polymerizable hole transport compound, which has been excited by high energy rays, to such a cyano compound, the hole transport compound in the excited state is rapidly deactivated, thereby preventing occurrence of a problem in that the hole transport compound in the excited state causes a decomposition reaction.

In this regard, cyano compounds for use in the present invention are known as electron transport materials for use in photoreceptors. However, the function of such cyano compounds in the present invention is not to impart an electron transport property to the photoreceptor, but is to inhibit decomposition of a radically polymerizable hole transport compound in a crosslinking reaction and decomposition of the resultant crosslinked hole transport material in the protective layer. Therefore, the added amount of a cyano compound is determined in consideration of this function.

Since cyano compounds for use in the present invention have a higher oxidation potential than radically polymerizable hole transport compounds, the cyano compounds do not serve as hole traps, thereby hardly deteriorating the hole transport ability of the hole transport compounds. In addition, since the energy gap between HOMO (highest occupied molecular orbital) and LUMO (lowest unoccupied molecular orbital) of such cyano compounds is narrower than that of radically polymerizable hole transport compounds, the cyano compounds can easily cause energy transference. Therefore, it is considered that the cyano compounds can inhibit photo-decomposition of a radically polymerizable hole transport compound when the compound is exposed to high energy rays while reducing the number of charge traps in the protective layer without deteriorating the basic properties of the photoreceptor such as electric properties and mechanical properties.

Since the number of charge traps in the protective layer is thus reduced, the potential properties such as evenness of potentials of the photoreceptor from place to place and stability of potential in repeated use are hardly affected by uneven exposure of the protective layer to ultraviolet rays in the crosslinking process. Thus, the potential properties of the photoreceptor can be enhanced. By using such a photoreceptor, high quality images with good image density uniformity can be produced.

Next, the photoreceptor of the present invention will be described in detail.

FIG. 1 is a cross-sectional view illustrating an example of the photoreceptor of the present invention. The photoreceptor illustrated in FIG. 1 has an electroconductive substrate 31, a charge generation layer 35, which has a charge generating function and which is located on the electroconductive substrate 31, a hole transport layer 37 located on the charge generation layer 35, and a hole transport protective layer 39 located on the hole transport layer 37. These four layers are essential for the photoreceptor of the present invention, and the photoreceptor can optionally include one or more undercoat layers between the electroconductive substrate 31 and the charge generation layer 35. In this regard, the combination of the charge generation layer 35, the hole transport layer 37 and the hole transport protective layer 39 serves as a photosensitive layer 33.

The electroconductive substrate 31 is not particularly limited as long as the substrate has a volume resistivity of not greater than $10^{10}$ Ω·cm. Specific examples of such electroconductive substrate include aluminum drums, films with evaporated aluminum, and nickel belts. In order that the photoreceptor can produce high quality images so as to be used for commercial printing, the photoreceptor has to have a high dimensional accuracy. Therefore, it is preferable to use an aluminum drum, which is prepared by a drawing method and whose surface is subjected to cutting and polishing to enhance the smoothness and the dimension accuracy, as the electroconductive substrate 31. Further, endless nickel belts disclosed in published unexamined Japanese patent application No. 52-36016 can also be used as the electroconductive substrate 31.

Any known charge generation layers for use in conventional organic photoreceptors can be used as the charge generation layer 35 of the photoreceptor of the present invention. Specifically, the charge generation layer 35 includes a charge generation material as a main component, and optionally includes a binder resin. Specific examples of the charge generation material include phthalocyanine pigments such as metal phthalocyanine and metal-free phthalocyanine, and azo dyes. Specific examples of the metal phthalocyanine include titanyl phthalocyanine, chlorogallium phthalocyanine, and hydroxygallium phthalocyanine. These charge generation materials can be used alone or in combination.

Specific examples of the binder resin, which is optionally included in the charge generation layer, include polyamide, polyurethane, epoxy resins, polyketone, polycarbonate, silicone resins, acrylic resins, polyvinyl butyral, polyvinyl formal, polyvinyl ketone, polystyrene, poly-N-vinylcarbazole, polyacrylamide, and the like. These resins can be used alone or in combination.

The charge generation layer 35 is typically prepared by applying a charge generation layer coating liquid, which is prepared by dispersing a charge generation material in a solvent optionally together with a binder resin (which can be dissolved or dispersed in the solvent) using a dispersing machine such as ball mills, attritors, and sand mills, followed by properly diluting the liquid, and then drying the coated liquid. Specific examples of the solvent for use in the charge generation layer coating liquid include organic solvents such as tetrahydrofuran, dioxane, dioxolan, toluene, dichloromethane, monochlorobenzene, dichloroethane, cyclohexanone, cyclopentanone, anisole, xylene, methyl ethyl ketone, acetone, ethyl acetate, butyl acetate, and the like. These solvents can be used alone or in combination. The charge generation layer coating liquid can optionally include a leveling agent such as dimethyl silicone oils, and methylphenyl silicone oils.

The thus prepared charge generation layer coating liquid is applied on an electroconductive substrate with one or more optional undercoat layers therebetween, and the coated liquid is dried. Suitable coating methods include known coating methods such as dip coating, spray coating, bead coating, and ring coating. The charge generation layer preferably has a thickness of from 0.01 μm to 5 μm, and more preferably from 0.05 μm to 2 μm.

Next, the hole transport layer 37, which is located on the charge generation layer 35 and which includes a hole transport material and a binder resin as main components, will be described. Known charge transport layers can be used for the hole transport layer.

Known hole transport materials can be used as the hole transport material. Specific examples of the hole transport material include oxazole derivatives, imidazole derivatives, monoarylamine derivatives, diarylamine derivatives, triarylamine derivatives, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, and the like. These materials can be used alone or in combination.

Specific examples of the binder resin for use in the hole transport layer include known thermoplastic resins and thermosetting resins, such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylate, phenoxy resins, polycarbonate, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins, and the like. The added amount of a hole transport material to be included in the hole transport layer is from 20 to 300 parts by weight, and preferably from 40 to 150 parts by weight, per 100 parts by weight of the binder resin included in the hole transport layer. The hole transport layer can be prepared by applying a coating liquid by a coating method such as the coating methods mentioned above for use in preparing the charge generation layer. One or more of the solvents mentioned above for use in the charge generation layer coating liquid are used for the hole transport layer coating liquid. Among the solvents, solvents capable of well dissolving the charge transport material and binder resin used are preferably used. Specific examples of the coating method include the coating methods mentioned above for use in preparing the charge generation layer 35.

The hole transport layer coating liquid can include a plasticizer, and/or a leveling agent, if necessary. Specific examples of the plasticizer include known plasticizers for use in resins such as dibutyl phthalate and dioctyl phthalate. The added amount of such a plasticizer is from 0 to 30 parts by weight per 100 parts by weight of the binder resin included in the hole transport layer. Specific examples of the leveling agent include silicone oils (e.g., dimethylsilicone oils and methylphenylsilicone oils), and polymers and oligomers having a perfluoroalkyl group in a side chain thereof. The added amount of such a leveling agent is from 0 to 1 part by weight per 100 parts by weight of the binder resin included in the hole transport layer.

The thickness of the hole transport layer is preferably from 5 μm to 40 μm, and more preferably from 10 μm to 30 μm.

Next, the hole transport protective layer 39, which is located on the hole transport layer 37, will be described.

The hole transport protective layer includes a three-dimensionally crosslinked material, which is prepared by radically chain-polymerizing a radically polymerizable hole transport compound using high energy rays such as ultraviolet rays and electron beams, and a specific cyano compound, which is included in a film of the crosslinked material. The three dimensionally crosslinked material is hereinafter sometimes referred to as an UV or EB crosslinked material.

The cyano compound included in the protective layer has the following formula (1) or (2).

FORMULA (1)

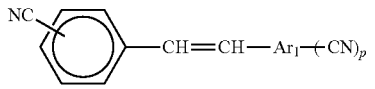

wherein $Ar_1$ represents a mono- or di-valent benzene ring or a mono- or di-valent condensed polycyclic hydrocarbon group having 10 to 14 carbon atoms; and p is 0 or 1; and

FORMULA (2)

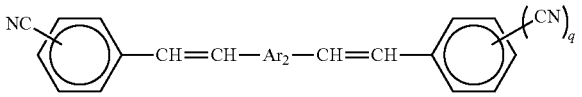

wherein $Ar_2$ represents a mono- or di-valent benzene ring or a mono- or di-valent condensed polycyclic hydrocarbon group having 10 to 14 carbon atoms; and q is 0 or 1.

Specific examples of the condensed polycyclic hydrocarbon having 10 to 14 carbon atoms in the groups $Ar_1$ and $Ar_2$ include naphthalene, fluorenone, phenanthrene, anthracene, and the like.

These cyano compounds can be synthesized by a conventional method. For example, a cyano stilbene compound can be synthesized by subjecting diethyl ester of cyanobenzylphosphoric acid and benzaldehyde to a modified Wittig reaction, and a dicyanodistilyl aromatic compound can be synthesized by subjecting diethyl ester of cyanobenzylphosphoric acid and an aromatic dialdehyde compound to the modified Wittig reaction.

Specific examples of the cyano compound having formula (1) include the following compounds, but are not limited thereto.

TABLE 1

| COMPOUND No. | FORMULA |
|---|---|
| 1 | 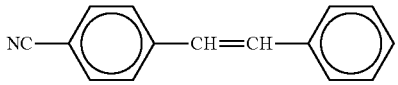 |
| 2 | 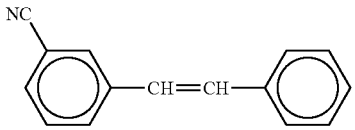 |
| 3 | 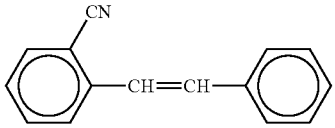 |
| 4 | 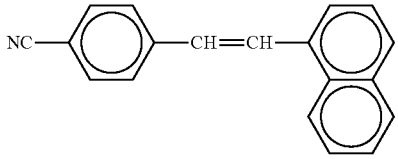 |
| 5 | 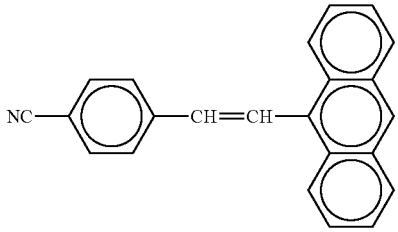 |

TABLE 1-continued

| COMPOUND No. | FORMULA |
|---|---|
| 6 | 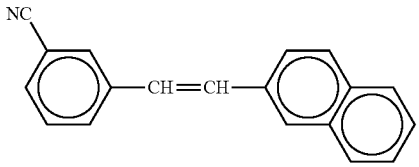 |
| 7 | 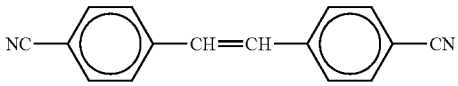 |
| 8 | 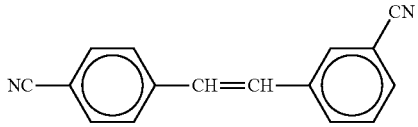 |
| 9 | 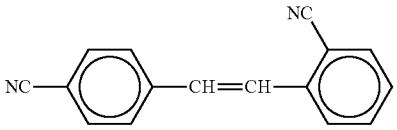 |
| 10 | 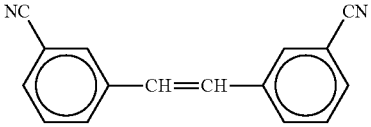 |

Specific examples of the cyano compound having formula (2) include the following compounds, but are not limited thereto.

TABLE 2

| | |
|---|---|
| 11 | 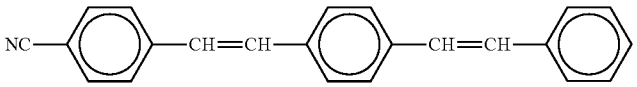 |
| 12 | 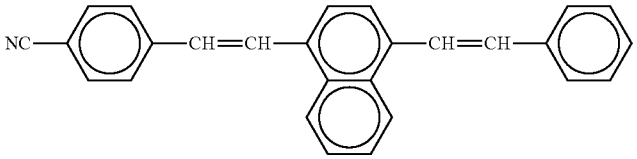 |

TABLE 2-continued
| | |
|---|---|
| 13 | 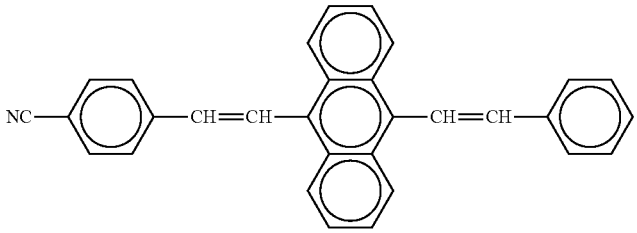 |
| 14 | 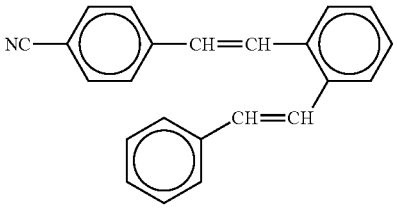 |
| 15 | 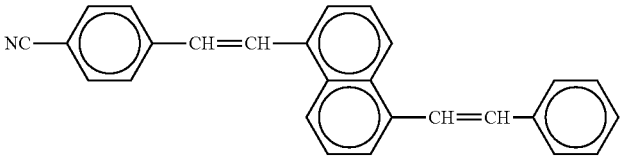 |
| 16 | 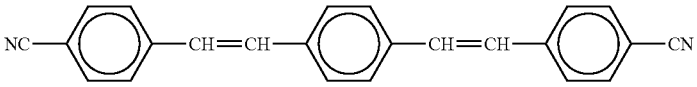 |
| 17 | 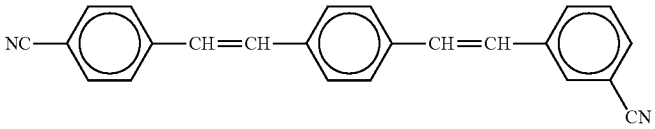 |
| 18 | 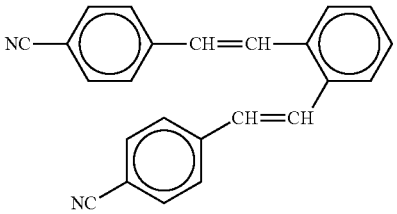 |
| 19 | 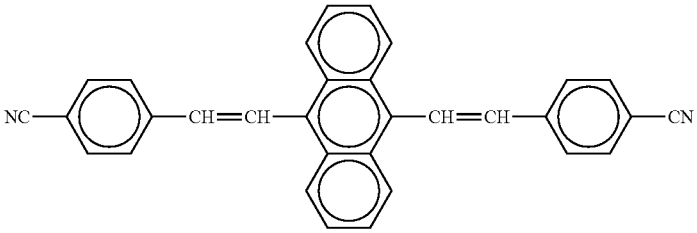 |
| 20 | 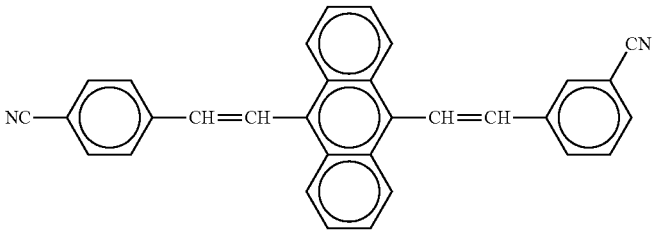 |

Such a cyano compound is included in the hole transport protective layer in an amount of from 0.1% to 30% by weight based on the weight of the radically polymerizable hole transport compound used for forming the protective layer. When the added amount is too small, the effect of reducing the in-plane potential variation is hardly produced. In contrast, when the added amount is too large, the photosensitivity of the photoreceptor deteriorates.

As mentioned above, the cyano compounds do not exhibit hole transportability. Therefore, when the added amount of such a cyano compound is too large, the content of the hole transport compound in the protective layer decreases, thereby deteriorating the photosensitivity of the photoreceptor. In addition, the cross-linkage density of the radically polymerized material is also decreased, resulting in deterioration of the mechanical strength and abrasion resistance of the photoreceptor. Therefore, it is preferable to include such a cyano compound in the protective layer in as small amount as possible in the above-mentioned range. As a result of the present inventors' experiments, the added amount of such a cyano compound is preferably from 0.5% to 10% by weight based on the weight of the radically polymerizable hole transport compound used for forming the protective layer (i.e., the weight ratio (C/RHTM) of a cyano compound (C) to the radically polymerizable hole transport compound (RHTM) is 0.005/1 to 0.1/1) because the charge trap reducing effect can be satisfactorily produced while hardly causing a side effect.

Next, the method of forming the hole transport protective layer and constituents of the protective layer other than the cyano compound will be described.

The hole transport protective layer includes a three-dimensionally crosslinked material of a radically polymerizable hole transport compound. In order to cause a three-dimensional crosslinking reaction, one of the following conditions has to be satisfied.

1. When the radically polymerizable hole transport compound used has one radically polymerizable functional group in a molecule, a polyfunctional radically polymerizable monomer having two or more radically polymerizable functional groups in a molecule is mixed therewith, and the mixture is subjected to a radical chain polymerization reaction.
2. When the radically polymerizable hole transport compound used has two or more radically polymerizable functional groups in a molecule, a polyfunctional radically polymerizable monomer having one or more radically polymerizable functional groups in a molecule is mixed therewith, and the mixture is subjected to a radical chain polymerization reaction.

By performing a radical chain polymerization reaction under one of the above-mentioned conditions, a three-dimensionally crosslinked film can be prepared. When only a compound having only one radically polymerizable functional group is used, only a linear polymer is obtained. In this case, the resultant polymer may be insoluble in solvents due to entanglement of the molecular chains of the polymer, but cannot form a crosslinked film having so good abrasion resistance as to be used for the hole transport protective layer.

In the case 1 mentioned above, it is more preferable to use a mixture of a radically polymerizable hole transport compound having one radically polymerizable functional group in a molecule and a polyfunctional radically polymerizable monomer having three or more radically polymerizable functional groups in a molecule. In this case, even when the added amount of such a polyfunctional radically polymerizable monomer having three or more radically polymerizable functional groups is small, a crosslinked layer having a high cross-linkage density (i.e., good mechanical strength) can be prepared while increasing the content of a unit obtained from the radically polymerizable hole transport compound in the protective layer, resulting in enhancement of the hole transportability of the protective layer.

In addition, when the hole transport protective layer is prepared, the polymerization reaction is induced by using high energy rays such as ultraviolet rays and electron beams to form a crosslinked material. Using such high energy rays makes it possible to prepare a crosslinked layer having a higher hardness and a larger elastic deformation amount than a thermally crosslinked layer prepared by using a heat polymerization initiator. Therefore, it is essential to use high energy rays for forming the hole transport protective layer. Since the energy of such high energy rays applied to a mixture of a radically polymerizable hole transport compound and a polyfunctional radically polymerizable monomer is higher than heat energy used for a thermal crosslinking reaction, the hole transport structure is excited by such high energy rays, and thereby the above-mentioned problems specific to the conventional crosslinked protective layers are caused. In order to reduce the chance of occurrence of the problems, several techniques such that the crosslinking reaction is performed under an inert gas condition such as nitrogen gas to reduce the content of oxygen; and the system is cooled to prevent increase of the temperature of the protective layer in the crosslinking reaction have been conventionally used. These techniques can also be used for the present invention.

It is known to prepare a three-dimensionally crosslinked layer having a good combination of hole transportability and abrasion resistance by subjecting a mixture of a radically polymerizable hole transport compound having one radically polymerizable functional group in a molecule, a radically polymerizable polyfunctional monomer having three or more radically polymerizable functional groups in a molecule, and a photo-polymerization initiator to a radical polymerization reaction using ultraviolet rays. This technique is preferably used for preparing the hole transport protective layer of the photoreceptor of the present invention.

Specifically, a radically polymerizable hole transport compound having one radically polymerizable functional group in a molecule, a polyfunctional radically polymerizable monomer having three or more radically polymerizable functional groups in a molecule, a photo-polymerization initiator, and such a cyano compound as mentioned above are dissolved in a proper solvent to prepare a protective layer coating liquid, and the coating liquid is applied on the hole transport layer, followed by ultraviolet ray irradiation to crosslink the protective layer. By using this method, a hole transport protective layer suitable for the photoreceptor of the present invention can be prepared.

In this regard, when the radically polymerizable monomer is a liquid, it is possible to dissolve other components in the monomer. In this case, the coating liquid may be diluted with one or more solvents. Specific examples of the solvent for use in preparing the protective layer coating liquid include alcohols such as methanol, ethanol, propanol, and butanol; ketones such as acetone, methyl ethyl ketone, methyl isobutyl ketone, and cyclohexanone; esters such as ethyl acetate, and butyl acetate; ethers such as tetrahydrofuran, dioxane, and propyl ether; halogenated solvents such as dichloromethane, dichloroethane, trichloroethane, and chlorobenzene; aromatic solvents such as benzene, toluene, and xylene; cellosolves such as methyl cellosolve, ethyl cellosolve, and cellosolve acetate; etc. These solvents can be used alone or in combination. The added amount of a solvent is not particularly limited, and is determined depending on the solubility of the components, coating methods, and the target thickness of the protective layer. Suitable coating methods for use in applying the protective layer coating liquid include dip coating, spray coating, bead coating, and ring coating.

When ultraviolet crosslinking is performed, light sources such as high pressure mercury lamps and metal halide lamps emitting UV light are preferably used. The intensity of UV light is preferably from 50 mW/cm$^2$ to 1,000 mW/cm$^2$. When the light intensity is too low, it takes a long time to crosslink the protective layer. In contrast, when the light intensity is too high, the crosslinking reaction unevenly proceeds, thereby causing problems in that serious wrinkles are formed in the resultant crosslinked protective layer; and the electric properties of the photoreceptor are deteriorated.

Specific examples of the radically polymerizable hole transport compound, the radically polymerizable tri- or more-functional monomer, and the photo-polymerization initiator for use in the present invention include the charge transport compounds having a radically polymerizable functional group; the radically polymerizable tri- or more-functional monomers having no charge transport structure and the radically polymerizable difunctional monomers having no charge transport structure; and the photo-polymerization initiators described in published Japanese patent applications Nos. 2005-266513 (corresponding to US2005221210), 2004-302452 and 2004-302450 incorporated herein by reference. In addition, specific examples of the solvent, the coating method, the drying method, and the ultraviolet irradiation conditions for use in preparing the protective layer of the present invention include those described in the publications incorporated herein by reference.

Specifically, suitable radically polymerizable hole transport compounds for use in the present invention include compounds having a hole transport structure such as triarylamine, hydrazone, pyrazoline, and carbazole structures, and a radically polymerizable functional group, which is preferably selected from acryloyloxy and methacryloyloxy groups. The number of the radically polymerizable functional group in a molecule is one or more. However, in order to prepare a protective layer having good surface smoothness by reducing the internal stress therein, the number of the radically polymerizable functional group is preferably one. When the radically polymerizable hole transport compound has two or more radically polymerizable functional groups, the hole transport structures are so bulky as to be fixed in the crosslinked bond, thereby causing large strain and deteriorating flexibility, resulting in formation of a layer having high surface roughness and cracks, and/or occurrence of peeling of the layer from the photosensitive layer. In addition, when the protective layer has large strain, the intermediate (i.e., cation radical) of the charge transport material in the charge transport process becomes unstable, thereby deteriorating the photosensitivity of the photoreceptor due to formation of charge traps while increasing the residual potential of the photoreceptor. Among the hole transport structures, triarylamine structure is preferable because of having high hole mobility.

The radically polymerizable hole transport compound is important in order to impart good hole transportability to the crosslinked hole transport protective layer. The added amount of such a radically polymerizable hole transport compound is preferably from 20% to 80% by weight, and more preferably from 30% to 70% by weight, based on the total weight of the constituents of the protective layer (i.e., non-volatile components in the protective layer coating liquid). When the added amount is smaller than 20% by weight, it is hard to impart good hole transportability to the resultant protective layer, resulting in occurrence of problems in that the electric properties such as photosensitivity and residual potential of the photoreceptor deteriorate after repeated use. In contrast, when the added amount is greater than 80% by weight, the amount of the radically polymerizable tri- or more-functional monomer in the coating liquid decreases, thereby decreasing the cross-linkage density of the crosslinked protective layer, resulting in deterioration of the abrasion resistance of the photoreceptor.

The targets of the abrasion resistance and electrostatic properties of the crosslinked protective layer vary depending on the image forming processes for which the photoreceptor is used. Therefore, the added amount of the radically polymerizable hole transport compound is not unambiguously determined, but the amount is preferably from 30% to 70% by weight in order to balance the properties.

The radically polymerizable polyfunctional monomer for use in the present invention means monomers having no hole transport structure such as triarylamine, hydrazone, pyrazoline, and carbazole structures while having three or more radically polymerizable functional groups in a molecule. The radically polymerizable functional group means any radically polymerizable groups having a C—C double bond.

Specific examples of the radically polymerizable polyfunctional monomers having three or more radically polymerizable functional groups include, but are not limited thereto, trimethylolpropane triacrylate (TMPTA), trimethylolpropane trimethacylate, trimethylolpropane alkylene-modified triacrylate, trimethylolpropane ethyleneoxy-modified triacrylate, trimethylolpropane propyleneoxy-modified triacrylate, trimethylolpropane caprolactone-modified triacrylate, trimethylolpropane alkylene-modified trimethacrylate, pentaerythritol triacrylate, pentaerythritol tetraacrylate (PETTA), glycerol triacrylate, glycerol epichlorohydrin-modified triacrylate, glycerol ethyleneoxy-modified triacrylate, glycerol propyleneoxy-modified triacrylate, tris(acryloxyethyl)isocyanurate, dipentaerythritol hexaacrylate (DPHA), dipentaerythritol caprolactone-modified hexaacrylate, dipentaerythritol hydroxypentaacrylate, alkylated dipentaerythritol tetraacrylate, alkylated dipentaerythritol triacrylate, dimethylolpropane tetraacrylate (DTMPTA), pentaerhythritol ethoxytriacrylate, ethyleneoxy-modified triacryl phosphate, 2,2,5,5-tetrahydroxymethylcyclopentanone tetraacrylate, or the like. These monomers can be used alone or in combination.

In order to form a dense crosslinked network in the crosslinked protective layer, the ratio (Mw/F) of the molecular weight (Mw) of a radically polymerizable polyfunctional monomer to the number of functional groups (F) included in a molecule of the monomer is preferably not greater than 250. When the ratio is too greater than 250, the resultant protective layer tends to become soft, thereby deteriorating the abrasion resistance of the layer. In this case, it is not preferable to use only one monomer that is modified with a group having a long chain such as ethylene oxide, propylene oxide and caprolactone.

The added amount of a radically polymerizable polyfunctional monomer is preferably from 20% to 80% by weight, and more preferably from 30% to 70% by weight, based on the total weight of the solid components included in the protective layer coating liquid. When the added amount is smaller than 20% by weight, the three dimensional cross-linkage density decreases, and thereby abrasion resistance much better than that of conventional protective layers prepared by using a thermoplastic binder resin cannot be imparted to the resultant protective layer. In contrast, when the added amount is larger than 80% by weight, the amount of the hole transport compound in the coating liquid decreases, resulting in deterioration of the electric properties of the photoreceptor. The targets of the abrasion resistance and electrostatic properties of the crosslinked protective layer vary depending on the image forming processes for which the photoreceptor is used. Therefore, the added amount of the radically polymerizable polyfunctional monomer is not unambiguously determined, but the amount is preferably from 30% to 70% by weight in order to balance the properties.

Any known photo-polymerization initiators, which can generate a radical upon receipt of light, can be used as the photo-polymerization initiator. Specific examples of the photo-polymerization initiators include acetophenone or ketal type photopolymerization initiators such as diethoxyacetophenone, 2,2-dimethoxy-1,2-diphenylethane-1-one, 1-hydroxy-cyclohexyl-phenyl-ketone, 4-(2-hydroxyethoxy) phenyl-(2-hydroxy-2-propyl)ketone, 2-benzyl-2-dimethylamino-1-(4-morpholinophenyl)butanone-1,2-hydroxy-2-methyl-1-phenylpropane-1-one, 2-methyl-2-morpholino(4-methylthiophenyl)propane-1-one, and 1-phenyl-1,2-propanedione-2-(o-ethoxycarbonyl)oxime; benzoin ether type photopolymerization initiators such as benzoin, benzoin methyl ether, benzoin ethyl ether, benzoin isobutyl ether, and benzoin isopropyl ether; benzophenone type photopolymerization initiators such as benzophenone, 4-hydroxybenzophenone, o-benzoylbenzoic acid methyl ester, 2-benzoyl naphthalene, 4-benzoyl biphenyl, 4-benzoyl phenyl ether, acrylated benzophenone, and 1,4-benzoyl benzene; thioxanthone type photopolymerization initiators such as 2-isopropylthioxanthone, 2-chlorothioxanthone, 2,4-dimethylthioxanthone, 2,4-diethylthioxanthone, and 2,4-dichlorothioxanthone; and other photopolymerization initiators such as ethylanthraquinone, 2,4,6-trimethylbenzoyldiphenylphosphineoxide, 2,4,6-trimethylbenzoylphenylethoxyphosphineoxide, bis(2,4,6-trimethylbenzoyl)phenylphosphineoxide, bis(2,4-dimethoxybenzoyl)-2,4,4-trimethylpentylphosphineoxide, methylphenylglyoxyester, 9,10-phenanthrene, acridine compounds, triazine compounds, imidazole compounds, and the like.

The added amount of the polymerization initiator is preferably from 0.5 to 40 parts by weight, and more preferably from 0.5 to 10 parts by weight, per 100 parts by weight of the total weight of the polymerizable materials included in the protective layer coating liquid.

In order to reduce the viscosity of the protective layer coating liquid, to relax the stress of the protective layer, and to reduce the surface energy and friction coefficient of the protective layer, known radically polymerizable mono- or difunctional monomers or oligomers can be used in combination of a radically polymerizable polyfunctional monomer.

Next, a case where a radically polymerizable hole transport compound having two or more functional groups is used for preparing the crosslinked hole transport protective layer will be described.

Specifically, compounds having, as a hole transport structure, an aromatic tertiary amine structure such as triarylamine, hydrazone, pyrazoline, and carbazole structures, and two or more radically polymerizable groups in a molecule can be used therefor. Specific examples thereof include compounds described in Tables 3-86 of the published unexamined Japanese patent application No. 2004-212959 incorporated herein by reference. Acryloyloxy and methcryloyloxy groups are preferably used as the radically polymerizable group of the radically polymerizable hole transport compound. It is more preferable that an acryloyloxy or methcryloyloxy group is connected with a hole transport structure with an alkylene chain having two or more (preferably three or more) carbon atoms therebetween to prevent occurrence of the above-mentioned problem, which is specific to a layer prepared by using a radically polymerizable di- or more-functional hole transport compound and in which large strain is caused in the resultant layer.

Next, the method of forming a crosslinked protective layer using electron beams will be described.

When an electron beam crosslinking method is used, it is not necessary to use a photo-polymerization initiator for the protective layer coating liquid. Specifically, after a coating liquid, in which a radically polymerizable hole transport compound, or a mixture of a radically polymerizable hole transport compound and a radically polymerizable monomer, is dissolved in a proper solvent, is applied on the surface of the hole transport layer, the coated layer is irradiated with electron beams to form a three-dimensionally crosslinked protective layer. The crosslinking conditions described in the above-described JP 2004-212959 can be applied for the present invention. Specifically, the electron acceleration voltage is preferably not greater than 250 kV, the exposure is preferably from 1 to 20 Mrad, and the oxygen concentration in the atmosphere in the crosslinking operation is not greater than 10,000 ppm.

Next, the undercoat layer will be described.

The photoreceptor of the present invention can include an undercoat layer between the electroconductive substrate 31 and the photosensitive layer 33 (i.e., charge generation layer 35). The undercoat layer includes a resin as a main component. Since the upper layer (the photosensitive layer, i.e., charge generation layer) is formed on the undercoat layer typically by coating a liquid including an organic solvent, the resin in the undercoat layer preferably has good resistance to general organic solvents.

Specific examples of such resins include water-soluble resins such as polyvinyl alcohol resins, casein and polyacrylic acid sodium salts; alcohol soluble resins such as amide copolymers (nylon copolymers) and methoxymethylated polyamides; and thermosetting resins capable of forming a three-dimensional network such as polyurethane resins, melamine resins, alkyd-melamine resins, isocyanates, epoxy resins, and the like.

The undercoat layer can include a powder of metal oxides to prevent occurrence of moiré in the resultant images and to decrease residual potential of the resultant photoreceptor. Specific examples of such metal oxides include titanium oxide, silica, alumina, zirconium oxide, tin oxide, indium oxide, and the like.

The undercoat layer may be formed using a silane coupling agent, a titanium coupling agent or a chromium coupling agent. In addition, a layer of aluminum oxide which is formed by an anodic oxidation method, and a layer of an organic compound such as polyparaxylylene or an inorganic compound such as $SiO_2$, $SnO_2$, $TiO_2$, ITO or $CeO_2$, which is formed by a vacuum evaporation method, can also be preferably used as the undercoat layer. However, the undercoat layer is not limited thereto, and any known undercoat layers can also be used. The thickness of the undercoat layer is preferably 1 μm to 15 μm.

In order to improve stability of the photoreceptor to withstand environmental conditions and to prevent deterioration of photosensitivity and increase of residual potential, each of the hole transport protective layer, the hole transport layer, the charge generation layer and the undercoat layer of the photoreceptor can include an antioxidant.

Suitable antioxidants for use in the layers of the photoreceptor include the following compounds, but are not limited thereto.

(a) Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocopherol compounds, and the like.

(b) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like.

(c) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, and the like.

(d) Organic Sulfur-Containing Compounds dilauryl-3,3'-thiodipropionate, distearyl-3,3'-thiodipropionate, ditetradecyl-3,3'-thiodipropionate, and the like.

(e) Organic Phosphorus-Containing Compounds triphenylphosphine, tri(nonylphenyl)phosphine, tri(dinonylphenyl)phosphine, tricresylphosphine, tri(2,4-dibutylphenoxy)phosphine, and the like.

Since these compounds are commercialized as antioxidants for use in rubbers, plastics, and oil and fats, the compounds can be easily obtained.

The added amount of such an antioxidant is from 0.01% to 10% by weight of the weight of the layer to which the antioxidant is added.

Next, the image forming method and apparatus of the present invention will be described by reference to drawings.

The image forming method and apparatus of the present invention uses the above-mentioned photoreceptor of the present invention which is a layered photosensitive layer and in which a crosslinked hole transport protective layer having little potential variation with time and in-plane potential variation is formed as an outermost layer. The image forming method and apparatus include at least a charging process to charge the photoreceptor, an irradiating process to irradiate the charged photoreceptor to form an electrostatic latent image thereon, a developing process to develop the electrostatic latent image with a developer including a toner to form a toner image on the photoreceptor, a transferring process to transfer the toner image to an image supporter (recording material), a fixing process to fix the toner image on the recording material, and a cleaning process to clean the surface of the photoreceptor after the transfer process. The image forming process is not limited thereto, and it is possible to transfer the electrostatic latent image formed on the photoreceptor directly to a transfer medium, followed by a developing process, an optional transferring process, and a fixing process.

Figure 2:
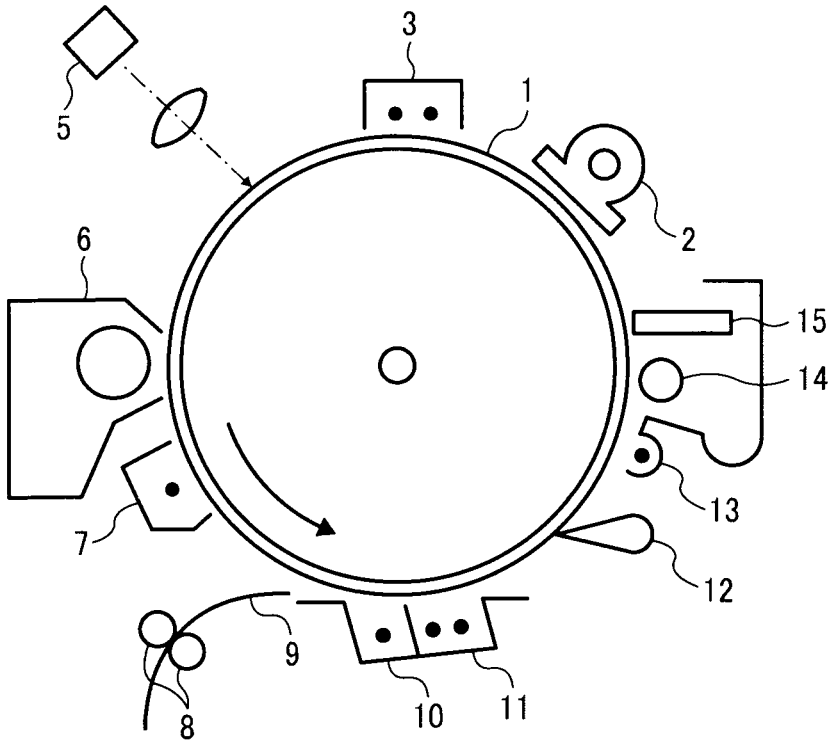
FIG. 2 is a schematic view illustrating an example of the image forming apparatus of the present invention.

FIG. 2 illustrates the image forming section of an example of the image forming apparatus of the present invention.

Referring to FIG. 2, the image forming section includes a photoreceptor 1 which serves as an image bearing member and which is the above-mentioned photoreceptor of the present invention, a charger 3 to charge the surface of the photoreceptor 1, an irradiator 5 to irradiate the charged photoreceptor 1 with light to form an electrostatic latent image on the photoreceptor 1, a developing device 6 to develop the electrostatic latent image with a developer including a toner to form a toner image on the photoreceptor 1, a transferring device to transfer the toner image onto a recording material 9 using a transfer charger 10 while separating the recording material from the photoreceptor 1 using a separation charger 11, a cleaning device to clean the surface of the photoreceptor 1 using a fur brush 14 and a blade 15 after transferring the toner image, and a discharger 2 to decay residual charges remaining on the surface of the photoreceptor 1 after cleaning the surface. Reference numerals 8 and 12 respectively denote a pair of registration rollers to timely feed the recording material 9 toward the transfer device 10 and 11, and a separation pick to separate the recording material 9 from the photoreceptor 1. Reference numeral 13 denotes a pre-cleaning charger to previously charge the photoreceptor 1 so that the surface of the photoreceptor 1 can be well cleaned with the cleaning device 14 and 15. Reference numeral 7 denotes a pre-transfer charger to previously charge the photoreceptor 1 so that the toner image can be well transferred onto the recording material 9.

Suitable chargers for use as the charger 3 include known chargers capable of uniformly charging the photoreceptor 1, such as corotrons, scorotrons, solid state dischargers, needle electrodes, charging rollers, electroconductive brushes, and the like. The photoreceptor of the present invention is preferably used for contact and non-contact short-range chargers, which tend to cause short-range discharging between the surface of the charger 3 and the surface of the photoreceptor 1, thereby increasing the chance of decomposing the components constituting the layers of the photoreceptor 1. In this regard, the contact chargers are such that a charging member such as charging rollers, charging brushes and charging blades is directly contacted with the photoreceptor 1, and the short-range chargers are such that a charging member such as charging rollers is arranged in the vicinity of the photoreceptor 1 while forming a gap of not greater than 200 μm therebetween to charge the photoreceptor 1. When the gap is too large, the photoreceptor tends to be unstably charged. In contrast, when the gap is too small, it is possible that the charging member is contaminated with toner particles remaining on the surface of the photoreceptor 1. Therefore, the gap is preferably from 10 μm to 200 μm, and more preferably from 10 μm to 100 μm.

The irradiator 5 has a light source to irradiate the charged photoreceptor 1 with light. Suitable light sources for use in the irradiator 5 include fluorescent lamps, tungsten lamps, halogen lamps, mercury lamps, sodium lamps, light emitting diodes (LEDs), laser diodes (LDs), light sources using electroluminescence (EL), and the like. In addition, in order to obtain light having a desired wave length range, filters such as sharp-cut filters, band pass filters, near-infrared cutting filters, dichroic filters, interference filters, color temperature converting filters and the like can be used.

The developing device 6 develops the electrostatic latent image on the photoreceptor 1 with a developer including a toner. Suitable developing methods include dry developing methods (such as one component developing methods using a toner as a one-component developer and two component developing methods using a two-component developer including a carrier and a toner), and wet developing methods.

When the photoreceptor 1, which is previously charged positively (or negatively), is exposed to imagewise light, an electrostatic latent image having a positive (or negative) charge is formed on the photoreceptor 1. When the latent image having a positive (or negative) charge is developed with a toner having a negative (or positive) charge, a positive image can be obtained. In contrast, when the latent image having a positive (negative) charge is developed with a toner having a positive (negative) charge, a negative image (i.e., a reversal image) can be obtained.

The toner image formed on the photoreceptor 1 is transferred to the recording material 9 by the transfer charger 10. In order to well perform the transfer operation, the pre-transfer charger 7 can be used. Suitable transfer methods include transfer methods using a transfer charger, electrostatic transfer methods using a bias roller, mechanical transfer methods such as adhesion transfer methods and pressure transfer methods, magnetic transfer methods, and the like. The above-mentioned chargers can be preferably used for the electrostatic transfer methods.

The recording material 9, on which the toner image has been transferred, is separated from the photoreceptor 1 by the separation charger 11 and the separation pick 12. Other separation methods such as separation methods utilizing electrostatic attraction, separation methods using a belt end, separation methods including griping the tip of a recording material, separation methods utilizing curvature, and the like can also be used. The above-mentioned chargers can be used for the separation charger 11.

The recording material 9 bearing a toner image is then fed to a fixing device to fix the toner image onto the recording material. Known fixing devices such as fixing devices using a heat roller and a pressure roller, and fixing devices using a fixing belt, a heat roller and a pressure roller can be used.

When the toner image formed on the photoreceptor 1 by the developing device 6 is transferred onto the recording material 9, the entire toner image is not transferred onto the recording material 9, and toner particles remain on the surface of the photoreceptor 1. The residual toner is removed from the photoreceptor 1 by the fur brush 14 and cleaning blade 15. In order to well clean the surface of the photoreceptor 1, the pre-cleaning charger 13 can be used. Other cleaning methods such as web cleaning methods and magnet brush cleaning methods can also be used. These cleaning methods can be used alone or in combination.

Suitable devices for use as the discharger 2 include discharging lamps and discharging chargers. The lamps mentioned above for use in the irradiator 5 and the chargers mentioned above for use in the charger 3 can be used for the discharger 2.

The image forming apparatus of the present invention can further include a document reader to read the image of an original image with an image reader; a feeding device to feed the recording material 9 toward the photoreceptor 1; and a copy discharging device to discharge the recording material 9 bearing a fixed image thereon (i.e., a copy) from the main body of the image forming apparatus. Known document readers, feeding devices, copy discharging devices, can be used for the image forming apparatus of the present invention.

Figure 3:
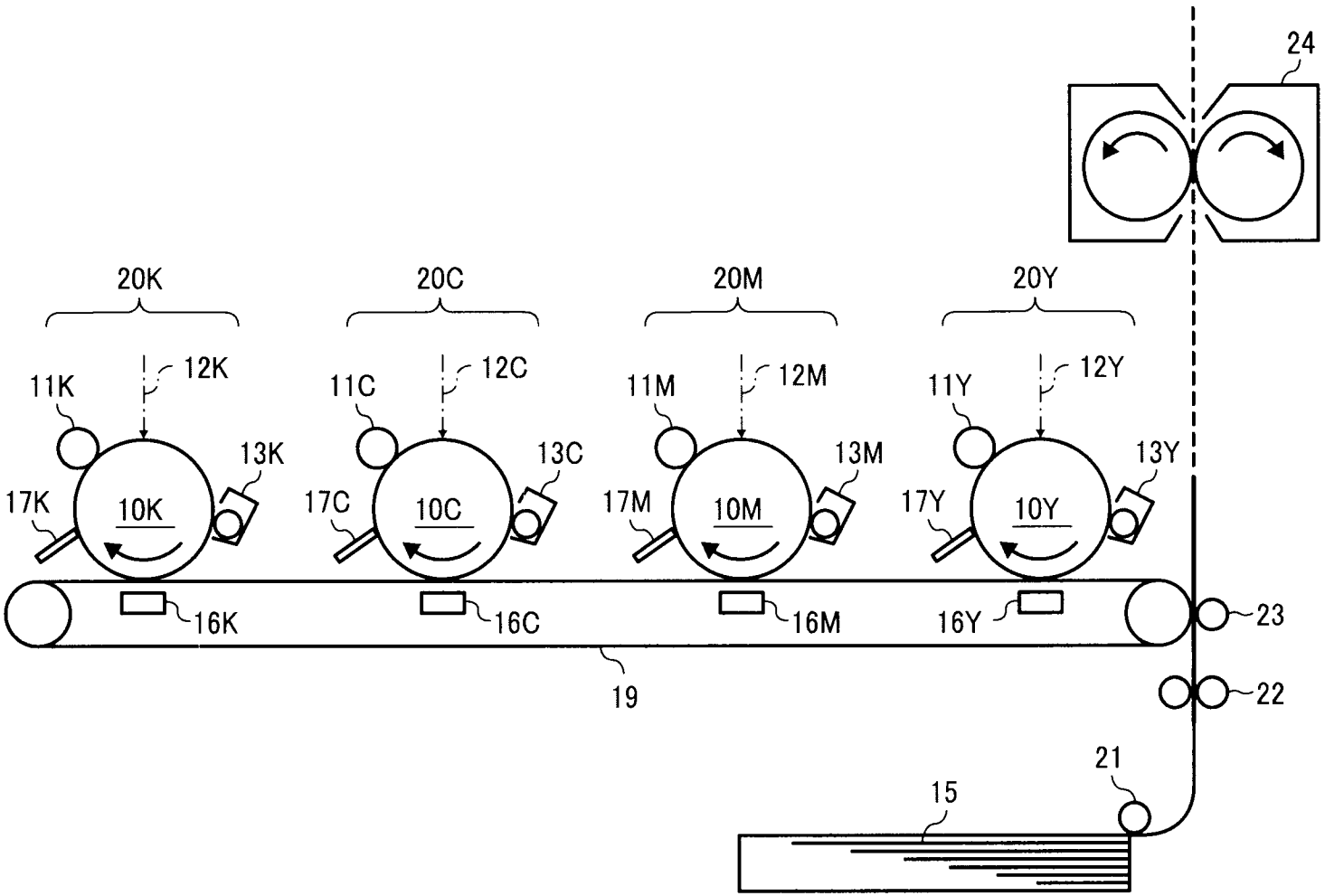
FIG. 3 is a schematic view illustrating another example of the image forming apparatus of the present invention.

FIG. 3 illustrates a tandem-type full color image forming apparatus, which is an example of the image forming apparatus of the present invention. The below-mentioned modified examples are also included in the present invention.

Referring to FIG. 3, the image forming apparatus includes four image forming units 20Y, 20M, 20C and 20K to form yellow (Y), magenta (M), cyan (C), and black (K) images, respectively. The four image forming units 20 have the same configuration except that the colors (Y, M, C and K) of the toners are different from each other. A photoreceptor 10 (10Y, 10M, 10C or 10K) having a drum-form is located in the center of the image forming unit 20. Each photoreceptor 10 is rotated in a direction indicated by an arrow. Around each photoreceptor 10, a charger 11 (11Y, 11M, 11C or 11K), a developing device 13 (13Y, 13M, 13C or 13K), and a cleaner 17 (17Y, 17M, 17C or 17K) are arranged.

Each photoreceptor 10 is exposed to laser light 12 (12Y, 12M, 12C or 12K) emitted by an irradiator (not shown) at a position between the charger 11 and the developing device 13, resulting in formation of an electrostatic latent image on the photoreceptor.

An intermediate transfer belt 19 serving as an image bearing member is arranged along the four image forming units 20.

The intermediate transfer belt 19 is contacted with each photoreceptor 10 at a position between the developing device 13 and the cleaner 17. Transferring members 16 (16Y, 16M, 16C and 16K) are provided in the circle of the intermediate transfer belt 19 so as to face to the respective photoreceptors 10 with the intermediate transfer belt 19 therebetween to apply a transfer bias to the intermediate transfer belt 19.

In the color image forming apparatus illustrated in FIG. 3, the image forming operation is performed as follows. Initially, the photoreceptor 10 is charged by the charger 11, which is rotated while driven by the photoreceptor 10, and is then exposed to laser light 12 emitted by an irradiator (not shown), thereby forming an electrostatic latent image on the photoreceptor 10.

The electrostatic latent image is developed by the developing device 13, thereby forming a yellow, magenta, cyan or black toner image on the photoreceptor 10. The four color toner images thus formed on the photoreceptors 10Y, 10M, 10C and 10K are transferred onto the intermediate transfer belt 19 so as to be overlaid, resulting in formation of a combined color toner image.

An uppermost sheet of a recording material 15 (such as paper sheet) in a tray is fed by a feeding roller 21 toward a pair of registration rollers 22. After the recording material sheet 15 is stopped once by the pair of registration rollers 22, the sheet 15 is timely fed to a secondary transfer nip formed by a secondary transfer member 23 and the intermediate transfer belt 19 so that the combined color toner image on the intermediate transfer belt 19 is transferred onto a proper position of the recording material sheet 15. In this regard, a transfer bias is applied to the secondary transfer member 23 to form an electric field between the secondary transfer member 23 and the intermediate transfer belt 19 so that the combined color toner image can be well transferred onto the recording material sheet 15. The recording material sheet 15 bearing the combined color toner image is then fed to a fixing device 24 so that the color toner image is fixed on the recording material sheet 15. The recording material sheet 15 bearing the fixed color toner image is then discharged on a copy tray (not shown). Residual toner, which remains on the photoreceptor 10 even after the toner image is transferred onto the intermediate transfer belt 19, is collected by the cleaner 17.

The intermediate transfer type image forming method illustrated in FIG. 3 is preferably used for forming full color images. By using such a method, formation of misaligned color images can be prevented and therefore high quality full color images can be produced.

Although the intermediate transfer belt 19 is used for the image forming apparatus, the shape of the intermediate transfer medium is not limited thereto, and any known intermediate transfer media including drum-form intermediate transfer media can also be used. By using an intermediate transfer medium, the life of the photoreceptor can be prolonged while enhancing the image qualities.

In the image forming apparatus illustrated in FIG. 3, the image forming units 20 are arranged in order of Y, M, C and K in the feeding direction of the intermediate transfer belt 19, but the order is not limited thereto. In addition, the image forming apparatus preferably has a mechanism to stop the image forming units 20Y, 20M and 20C when only black color images are formed.

The image forming units can be fixedly set to an image forming apparatus such as copiers, facsimiles and printers, or detachably attached to such an image forming apparatus as a process cartridge. An example of the process cartridge is illustrated in FIG. 4.

Figure 4:
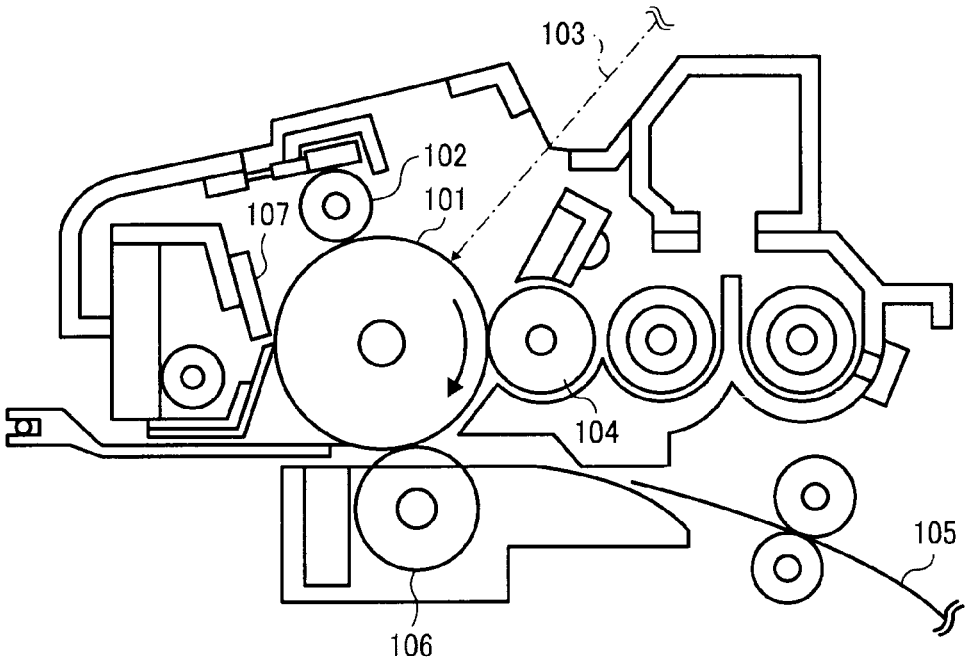
FIG. 4 is a schematic view illustrating an example of the process cartridge of the present invention.

FIG. 4 illustrates an example of the process cartridge of the present invention, and the process cartridge includes a photoreceptor 101, which is the photoreceptor of the present invention.

Around the photoreceptor 101, a charger 102 (a charging roller) to charge the photoreceptor 101 which rotates in a direction indicated by an arrow; a light beam 103 (emitted by a light irradiator (not shown) of an image forming apparatus) irradiating the photoreceptor 101 to form an electrostatic latent image thereon; a developing device (developing roller) 104 to develop the latent image with a developer including a toner to form a toner image on the photoreceptor 101; a transferring device 106 to transfer the toner image onto a recording material 105; and a cleaner including a blade 107 to clean the surface of the photoreceptor 101, are arranged. The photoreceptor 101 may be subjected to a discharging process in which residual charges remaining on the photoreceptor 101 even after the transfer process are decayed, using a discharging device such as the discharger 2 illustrated in FIG. 3.

The process cartridge illustrated in FIG. 4 is detachably attached to an image forming apparatus as a single unit. The process cartridge of the present invention is not limited thereto, and includes at least the photoreceptor 101, which is the photoreceptor of the present invention including a crosslinked hole transport protective layer and having little potential variation with time and in-plane potential variation, and one or more of a charger, a developing device, a transfer device, a cleaner and a discharger.

It is clear from the above description, the photoreceptor of the present invention can be preferably used for electrophotographic image forming apparatuses such as copiers, laser printers, CRT printers, LED printers, liquid crystal printers, and laser plate making machines.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

1. Preparation of Undercoat Layer

The following components were mixed.

| | |
|---|---|
| Alkyd resin (BECKOZOL 1307-60-EL from Dainippon Ink And Chemicals, Inc.) | 6 parts |
| Melamine resin (SUPER BECKAMIN G-821-60 from Dainippon Ink And Chemicals, Inc.) | 4 parts |
| Titanium dioxide (TIPAQUE CR-EL from Ishihara Sangyo Kaisha K.K. with average primary particle diameter of 0.25 μm) | 50 parts |
| Methyl ethyl ketone | 50 parts |

The mixture was subjected to ball milling for 48 hours using alumina balls, followed by filtering using a 500-mesh stainless screen, to prepare an undercoat layer coating liquid. The undercoat layer coating liquid was coated on a polished peripheral surface of an aluminum cylinder having a diameter of 60 mm by a dip coating method, and the coated liquid was dried for 20 minutes at 130° C. Thus, an undercoat layer having a thickness of 3.5 μm was prepared on the peripheral surface of the aluminum cylinder.

2. Preparation of Charge Generation Layer (1) Synthesis of Titanyl Phthalocyanine for Use as Charge Generation Material A titanyl phthalocyanine crystal was prepared by the method described in JP-A 2004-83859. Specifically, in a container 292 parts of 1,3-diiminoisoindoline and 1800 parts of sulfolane were mixed and agitated. Under a nitrogen gas flow, 204 parts of titanium tetrabutoxide was dropped therein. After titanium tetrabutoxide was added, the temperature of the mixture was gradually increased to 180° C. The temperature of the mixture was maintained in a range of from 170° C. to 180° C. for 5 hours while stirring the mixture to react the compounds. After the reaction was terminated, the reaction product was cooled. The reaction product was then filtered to obtain the precipitate. The precipitate was washed with chloroform until the precipitate colored blue. The precipitate was then washed with methanol several times, followed by washing with hot water of 80° C. several times. Thus, a crude titanyl phthalocyanine was prepared.

One part of the thus prepared crude titanyl phthalocyanine was gradually added to 20 parts of concentrated sulfuric acid to be dissolved therein. The solution was gradually added to 100 parts of ice water while agitated, to precipitate a titanyl phthalocyanine crystal. The titanyl phthalocyanine crystal was obtained by filtering. The crystal was washed with ion-exchange water (having pH of 7.0 and a conductivity of 1.0 μS/cm) until the filtrate became neutral. In this case, the pH and conductivity of the final filtrate were 6.8 and 2.6 μS/cm. Thus, an aqueous wet cake of the titanyl phthalocyanine pigment was prepared.

Forty (40) parts of the thus prepared aqueous wet cake of the titanyl phthalocyanine pigment was added to 200 parts of tetrahydrofuran and the mixture was strongly agitated at room temperature using a homomixer (MODEL MARK IIf from Kenis Ltd.), which was rotated at 2,000 rpm. When the color of the paste was changed from dark blue to light blue (after agitation for 20 minutes), agitation was stopped and the paste was subjected to filtering under a reduced pressure to obtain the crystal. The crystal was washed with tetrahydrofuran to prepare a wet cake of a pigment. The pigment was dried for 2 days at 70° C. under a reduced pressure of 5 mmHg (0.67 Pa). Thus, 8.5 parts of a titanyl phthalocyanine crystal was prepared. In this regard, the solid content of the aqueous wet cake was 15% by weight. In this crystal change process, the weight ratio of the wet cake of the pigment to the crystal change solvent (tetrahydrofuran) was 1:33. The raw materials used for preparing the titanyl phthalocyanine crystal did not include a halogenated compound.

Figure 7:
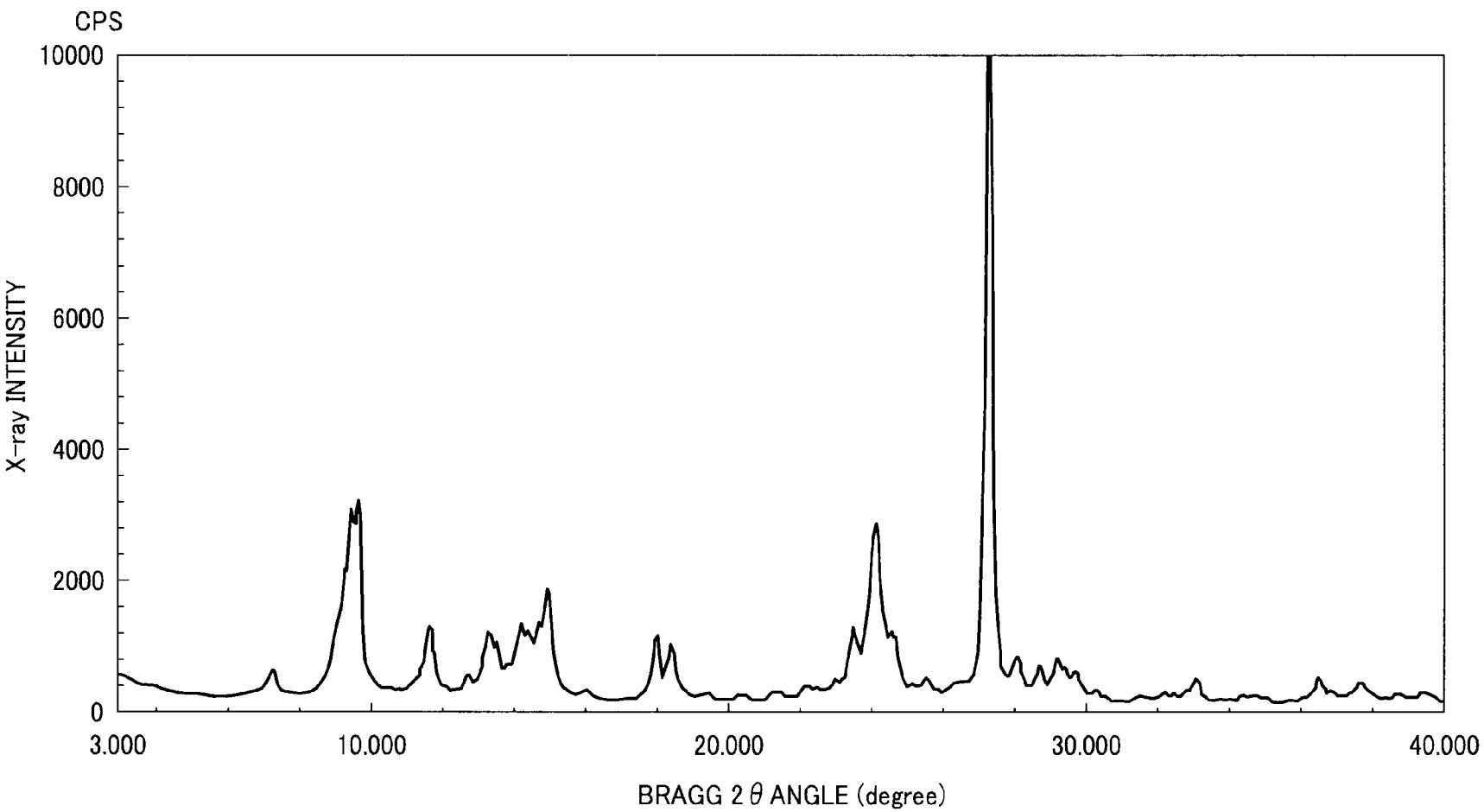
FIG. 7 is an X-ray diffraction spectrum of a titanyl phthalocyanine used for a photoreceptor of Example 1.

When the thus prepared titanyl phthalocyanine crystal was subjected to an X-ray diffraction analysis using a Cu—Kα X-ray having a wavelength of 1.542 Å, the titanyl phthalocyanine crystal had an X-ray diffraction spectrum such that a maximum peak is observed at a Bragg (2θ) angle of 27.2±0.2°, a lowest angle peak is observed at an angle of 7.3±0.2°, and a main peak is observed at each of angles of 9.4±0.2°, 9.6±0.2°, and 24.0±0.2°, wherein no peak is observed between the peaks of 7.3° and 9.4° and at an angle of 26.3°±0.2°. The X-ray diffraction spectrum thereof is illustrated in FIG. 7.

The X-ray diffraction analysis was performed under the following conditions:

X-ray tube: Cu
Voltage: 50 kV
Current: 30 mA
Scanning speed: 2°/min
Scanning range: 3° to 40°
Time constant: 2 seconds (2) Preparation of Charge Generation Layer The following components were mixed.

| | |
|---|---|
| Titanyl phthalocyanine crystal prepared above | 48 parts |
| Polyvinyl butyral (S-LEC BX-1 from Sekisui Chemical Co., Ltd.) | 32 parts |
| 2-Butanone | 720 parts |

The mixture was subjected to milling using a bead mill (DISPERMAT SL from VMA-GETZMANN GMBH, having a rotor with a diameter of 50 mm and a dispersing chamber with a volume of 125 ml) and zirconia balls with a diameter of 0.5 mm. In this dispersing treatment, initially a resin solution in which the polyvinyl butyral is dissolved in 2-butanone was fed to a tank and the resin solution was circulated in the circulating system. After confirming that the circulating system is filled with the resin solution and the resin solution is returned to the tank, the titanyl phthalocyanine crystal was fed to the tank. While agitating the mixture of the titanyl phthalocyanine crystal and the resin solution, the bead milling was performed for 300 minutes while rotating the rotor at a revolution of 3,000 rpm to perform a circulation dispersing treatment.

After the bead milling was completed, the resultant dispersion was fed from the bead mill. Further, 2,060 parts of 2-butanone was fed to the circulating system to be mixed with a part of the dispersion remaining in the bead mill, and the mixture was mixed with the dispersion, which had been fed from the bead mill. Thus, a charge generation layer coating liquid was prepared.

The charge generation layer coating liquid was coated on the undercoat layer by a dip coating method, and the coated liquid was dried for 20 minutes at 90° C. Thus, a charge generation layer having a thickness of about 0.2 μm was prepared.

3. Preparation of Hole Transport Layer

The following components were mixed to prepare a hole transport layer coating liquid.

| | |
|---|---|
| Bisphenol Z-form polycarbonate (PANLITE TS-2050 from Teijin Chemicals Ltd.) | 10 parts |
| Hole transport material having the following formula HTM-1 | 10 parts |

(HTM-1)

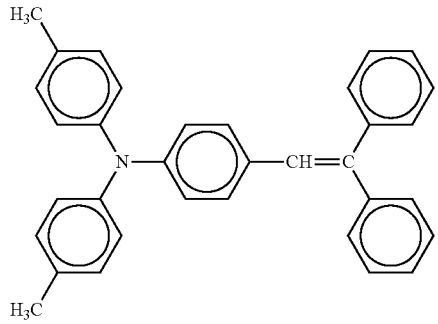

| | |
|---|---|
| Tetrahydrofuran | 100 parts |
| 1% tetrahydrofuran solution of silicon oil (Silicone oil: KF-50-100CS from Shin-Etsu Chemical Co., Ltd.) | 0.2 parts |
| Antioxidant (BHT (dibutylhydroxytoluene)) | 0.2 parts |

The hole transport layer coating liquid was coated on the charge generation layer by a dip coating method, and the coated liquid was dried for 30 minutes at 120° C. Thus, a hole transport layer having a thickness of about 22 μm was prepared.

4. Preparation of Crosslinked Protective Layer

The following components were mixed to prepare a protective layer coating liquid.

| | |
|---|---|
| Trimethylolpropane triacrylate serving as radically polymerizable polyfunctional monomer (KAYARAD TMPTA from Nippon Kayaku Co., Ltd., molecular weight (MW) of 296, number (N) of functional groups of 3, and ratio (MW/N) of 99) | 8 parts |
| Radically polymerizable hole transport compound having the following formula RHTM-1 | 10 parts |

(RHTM-1)

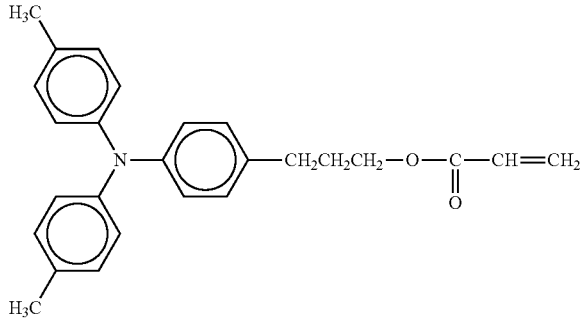

| | |
|---|---|
| 1-hydroxycyclohexyl phenyl ketone serving as photopolymerization initiator (IRGACURE 184 from Ciba Specialty Chemicals) | 1 part |

-continued

| | |
|---|---|
| Cyano compound<br>(Compound No. 1 described above in Table 1, the added amount is 5% based on the weight of the radically polymerizable hole transport compound RHTM-1) | 0.5 parts |
| Tetrahydrofuran | 100 parts |

The protective layer coating liquid was coated on the hole transport layer by a spray coating method, followed by natural drying for 20 minutes. The dried layer was exposed to UV light, followed by heating for 30 minutes at 130° C. to be crosslinked. The UV irradiation conditions were as follows:

Lamp used: Metal halide lamp with a power of 160 W/cm

Distance between lamp and photoreceptor: 120 mm

Illuminance: 50 mW/cm$^2$

Irradiation time: 180 seconds

Thus, a crosslinked hole transport protective layer having a thickness of 4.0 μm was prepared.

Thus, a photoreceptor of Example 1 was prepared.

Example 2

The procedure for preparation of the photoreceptor of Example 1 was repeated except that the hole transport material HTM-1 was replaced with a hole transport material HTM-2 having the below-mentioned formula, the radically polymerizable hole transport compound RHTM-1 was replaced with a radically polymerizable hole transport compound RHTM-2 having the below-mentioned formula, and the cyano compound No. 1 was replaced with the cyano compound No. 5 described above in Table 1.

(HTM-2)

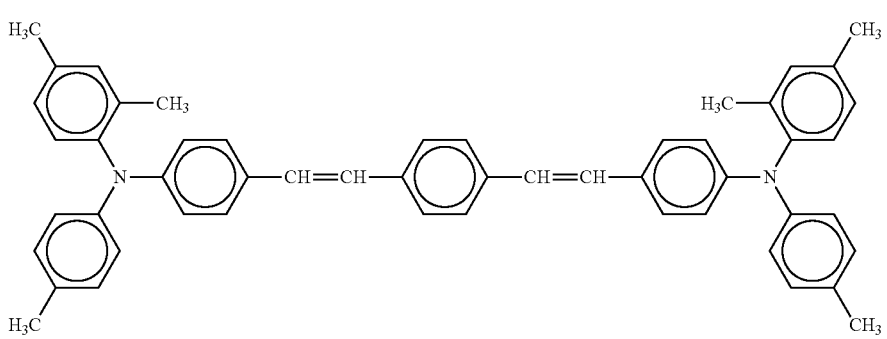

(RHTM-2)

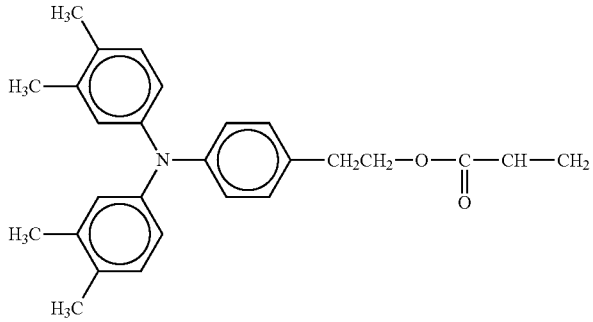

Thus, a photoreceptor of Example 2 was prepared.

Example 3

The procedure for preparation of the photoreceptor of Example 2 was repeated except that the radically polymerizable hole transport compound RHTM-2 was replaced with a radically polymerizable hole transport compound RHTM-3 having the below-mentioned formula, and the cyano compound No. 5 was replaced with the cyano compound No. 2 described above in Table 1.

(RHTM-3)

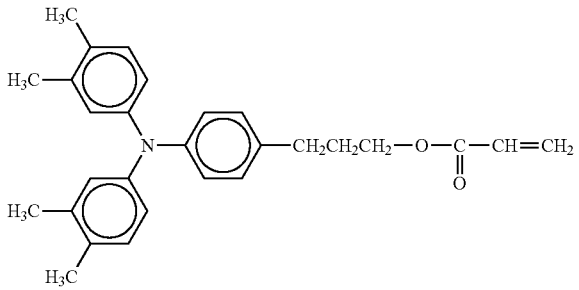

Thus, a photoreceptor of Example 3 was prepared.

Example 4

The procedure for preparation of the photoreceptor of Example 1 was repeated except that the hole transport protective layer coating liquid was replace with the following hole transport protective layer coating liquid.

| | |
|---|---|
| Trimethylolpropane triacrylate serving as first radically polymerizable polyfunctional monomer (KAYARAD TMPTA from Nippon Kayaku Co., Ltd., molecular weight (MW) of 296, number (N) of functional groups of 3, and ratio (MW/N) of 99) | 5 parts |
| Caprolactone-modified dipentaerythritol hexaacrylate (KAYARAD DPCA-120 from Nippon Kayaku Co., Ltd., molecular weight (MW) of 1947, number (N) of functional groups of 6, and ratio (MW/N) of 325) | 5 parts |
| Radically polymerizable hole transport compound having following formula RHTM-4 | 10 parts |

(RHTM-4)

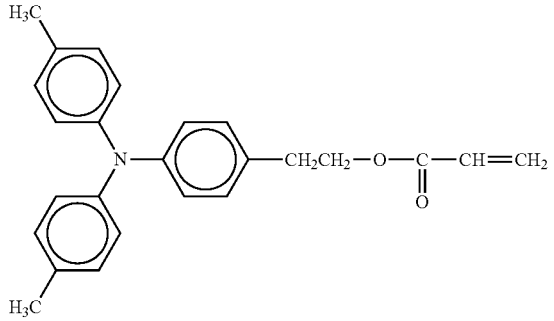

| | |
|---|---|
| 1-hydroxycyclohexyl phenyl ketone serving as photopolymerization initiator (IRGACURE 184 from Ciba Specialty Chemicals) | 1 part |
| Cyano compound (Compound No. 17 described above in Table 2, the added amount is 5% based on the weight of the radically polymerizable hole transport compound RHTM-4) | 0.5 parts |
| 1% tetrahydrofuran solution of silicone oil (Silicone oil: KF-50-100CS from Shin-Etsu Chemical Co., Ltd.) | 0.2 parts |
| Tetrahydrofuran | 100 parts |

Thus, a photoreceptor of Example 4 was prepared.

Example 5

The procedure for preparation of the photoreceptor of Example 1 was repeated except that the hole transport protective layer coating liquid was replace with the following hole transport protective layer coating liquid.

| | |
|---|---|
| Pentaerythritol tetraacrylate serving as radically polymerizable polyfunctional monomer (SR-295 from Sartmer Company Inc., molecular weight (MW) of 352, number (N) of functional groups of 4, and ratio (MW/N) of 88) | 10 parts |
| Radically polymerizable hole transport compound having following formula RHTM-5 | 10 parts |

(RHTM-5)

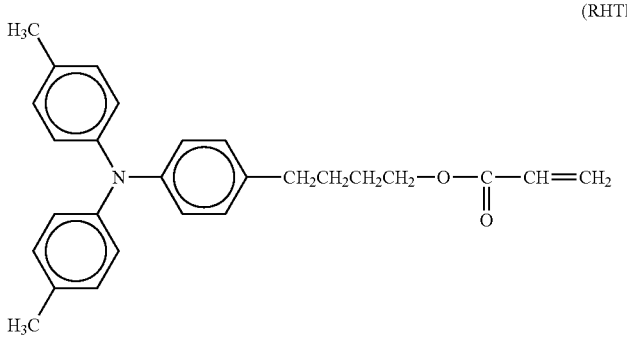

| | |
|---|---|
| 1-hydroxycyclohexyl phenyl ketone serving as photopolymerization initiator (IRGACURE 184 from Ciba Specialty Chemicals) | 1 part |
| Cyano compound (Compound No. 18 described above in Table 2, the added amount is 5% based on the weight of the radically polymerizable hole transport compound RHTM-5) | 0.5 parts |
| 1% tetrahydrofuran solution of silicone oil (Silicone oil: KF-50-100CS from Shin-Etsu Chemical Co., Ltd.) | 0.2 parts |
| Tetrahydrofuran | 100 parts |

Thus, a photoreceptor of Example 5 was prepared.

Example 6

The procedure for preparation of the photoreceptor of Example 1 was repeated except that the hole transport protective layer coating liquid was replace with the following hole transport protective layer coating liquid.

| | |
|---|---|
| Trimethylolpropane triacrylate serving as first radically polymerizable polyfunctional monomer (KAYARAD TMPTA form Nippon Kayaku Co., Ltd., molecular weight (MW) of 296, number (N) of functional groups of 3, and ratio (MW/N) of 99) | 5 parts |
| Caprolactone-modified dipentaerythritol hexaacrylate (KAYARAD DPCA-60 from Nippon Kayaku Co., Ltd., molecular weight (MW) of 1263, number (N) of functional groups of 6, and ratio (MW/N) of 211) | 5 parts |
| Radically polymerizable hole transport compound having following formula RHTM-6 | 10 parts |

(RHTM-6)

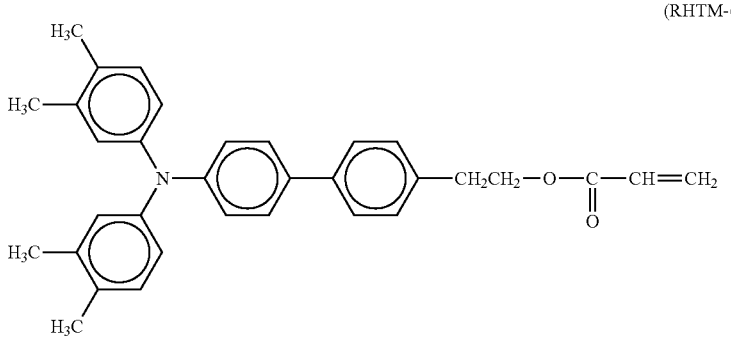

| | |
|---|---|
| 1-hydroxycyclohexyl phenyl ketone serving as photopolymerization initiator (IRGACURE 184 from Ciba Specialty Chemicals) | 1 part |
| Cyano compound (Compound No. 20 described above in Table 2, the added amount is 5% based on the weight of the radically polymerizable hole transport compound RHTM-6) | 0.5 parts |
| 1% tetrahydrofuran solution of silicone oil (Silicone oil: KF-50-100CS from Shin-Etsu Chemical Co., Ltd.) | 0.2 parts |
| Tetrahydrofuran | 100 parts |

Thus, a photoreceptor of Example 6 was prepared.

Example 7

The procedure for preparation of the photoreceptor of Example 1 was repeated except that the hole transport protective layer coating liquid was replace with the following hole transport protective layer coating liquid.

| | |
|---|---|
| Trimethylolpropane triacrylate serving as radically polymerizable polyfunctional monomer (KAYARAD TMPTA from Nippon Kayaku Co., Ltd., molecular weight (MW) of 296, number (N) of functional groups of 3, and ratio (MW/N) of 99) | 8 parts |
| Radically polymerizable hole transport compound having following formula RHTM-7 | 12 parts |

(RHTM-7)

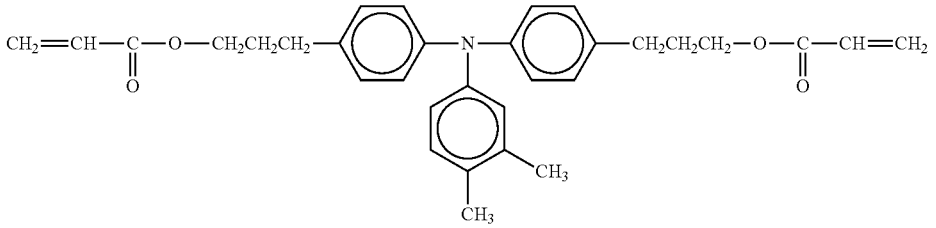

| | |
|---|---|
| 1-hydroxycyclohexyl phenyl ketone serving as photopolymerization initiator (IRGACURE 184 from Ciba Specialty Chemicals) | 1 part |
| Cyano compound | 0.5 parts |

-continued

| | |
|---|---|
| (Compound No. 7 described above in Table 1, the added amount is 4.2% based on the weight of the radically polymerizable hole transport compound RHTM-7) | |
| Tetrahydrofuran | 100 parts |

Thus, a photoreceptor of Example 7 was prepared.

Example 8

1. Preparation of Undercoat Layer

The procedure for preparation of the undercoat layer in Example 1 was repeated. Thus, an aluminum cylinder which has a diameter of 60 mm and which bears the undercoat layer was prepared.

2. Preparation of Charge Generation Layer

The following components were mixed.

| | |
|---|---|
| Bisazo pigment having following formula CGM-1 | 5 parts |

(CGM-1)

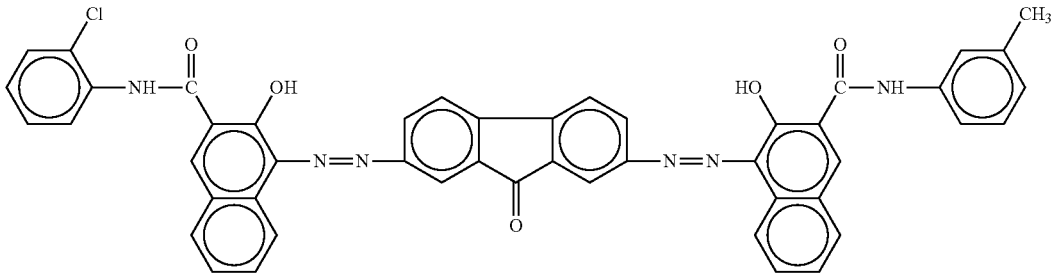

| | |
|---|---|
| Polyvinyl butyral | 2 parts |
| (S-LEC BX-1 from Sekisui Chemical Co., Ltd.) | |
| Cyclohexanone | 250 parts |
| 2-Butanone | 100 parts |

The mixture was subjected to ball milling using PSZ balls with a diameter of 10 mm. Specifically, a resin solution, which had been prepared by dissolving the polyvinyl butyral resin in the solvents, and the bisazo pigment were fed to a ball mill pot containing the PSZ balls, and the ball mill pot was rotated for 7 days at a revolution of 85 rpm, to prepare a charge generation layer coating liquid.

The charge generation layer coating liquid was coated on the undercoat layer by a dip coating method, and the coated liquid was dried for 20 minutes at 90° C. Thus, a charge generation layer having a thickness of about 0.2 μm was formed on the undercoat layer.

3. Preparation of Hole Transport Layer

The procedure for preparation of the hole transport layer in Example 1 was repeated except that the thickness of the hole transport layer was changed from 22 μm to 25 μm.

4. Preparation of Hole Transport Protective Layer

The procedure for preparation of the hole transport protective layer in Example 1 was repeated except that the hole transport protective layer coating liquid was replaced with the following hole transport protective layer coating liquid.

| | |
|---|---|
| Trimethylolpropane triacrylate serving as radically polymerizable polyfunctional monomer (KAYARAD TMPTA from Nippon Kayaku Co., Ltd., molecular weight (MW) of 296, number (N) of functional groups of 3, and ratio (MW/N) of 99) | 10 parts |
| Radically polymerizable hole transport RHTM-2 | 10 parts |

-continued

| | |
|---|---|
| Cyano compound (Compound No. 8 described above in Table 1, the added amount is 5% based on the weight of the radically polymerizable hole transport compound RHTM-2) | 0.5 parts |
| Tetrahydrofuran | 100 parts |

Thus, a photoreceptor of Example 8 was prepared.

Example 9

The procedure for preparation of the photoreceptor of Example 8 was repeated except that the hole transport protective layer coating liquid was replace with the following hole transport protective layer coating liquid.

| | |
|---|---|
| Radically polymerizable hole transport compound having following formula RHTM-8 | 20 parts |

(RHTM-8)

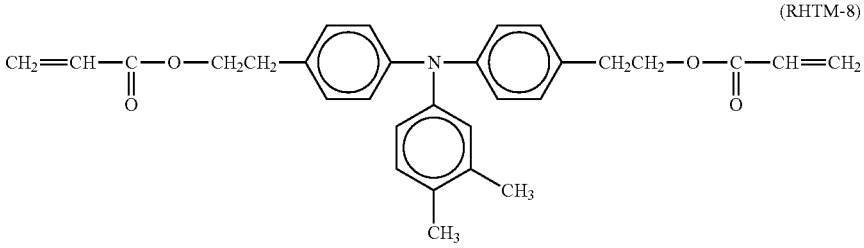

| | |
|---|---|
| Cyano Compound (Compound No. 10 described above in Table 1, the added amount is 2.5% based on the weight of the radically polymerizable hole transport compound RHTM-8) | 0.5 parts |
| Tetrahydrofuran | 100 parts |

Thus, a photoreceptor of Example 9 was prepared.

Comparative Examples 1-9

The procedure for preparation of each of the photoreceptors of Examples 1-9 was repeated except that the cyano compound was not included in the hole transport protective layer coating liquid.

Thus, photoreceptors of Comparative Examples 1-9 were prepared.

Each of the thus prepared photoreceptors of Examples 1-9 and Comparative Examples 1-9 was evaluated as follows.

1. Saturated Potential

Charge traps formed in a protective layer decrease the moving speed of holes or stop holes from moving, thereby deteriorating the photosensitivity or increasing the residual potential. When a photoreceptor charged so as to have a negative potential is exposed to light, the holes generated in the charge generating layer reach the surface of the photoreceptor after moving through the hole transport layer and the hole transport protective layer, thereby decaying the charges on the surface of the photoreceptor, resulting in decrease the surface potential.

As the surface potential decreases, the electric field formed on the photosensitive layer decreases, thereby decreasing the moving speed of the holes in the hole transport layer and the hole transport protective layer, and finally the surface potential does not decrease any more. The potential is called saturated potential. When charge traps are formed in the hole transport protective layer, the surface potential is not relatively decreased compared to a case where no charge traps are formed therein, resulting in increase of the saturated potential. Therefore, the saturated potential of each of the photoreceptors prepared above was measured to determine whether formation of charge traps is inhibited.

Specifically, each photoreceptor, which was rotated at a linear speed of 160 mm/sec, was charged with a scorotron charger so as to have a potential of −800V, followed by exposure to laser light having a wavelength of 655 nm and emitted by a laser diode (aperture of 70×80 μm, and resolution of 400 dpi). The residual potential of the photoreceptor at a time 80 msec after start of the exposure was measured. This procedure was repeated while increasing the illuminance. The residual potential saturates at a certain quantity of light. Namely, even when the quantity of light is increased so as to be greater than the certain quantity of light, the residual potential dose not further decrease. In this evaluation, the residual potential was measured when the quantity of light was 1 μJ/cm$^2$.

The results are shown in Table 3 below.

TABLE 3

| | Saturated potential (−V) |
|---|---|
| Example 1 | 119 |
| Example 2 | 117 |
| Example 3 | 114 |
| Example 4 | 79 |
| Example 5 | 81 |
| Example 6 | 78 |
| Example 7 | 118 |
| Example 8 | 119 |
| Example 9 | 106 |
| Comparative Example 1 | 220 |
| Comparative Example 2 | 208 |
| Comparative Example 3 | 201 |
| Comparative Example 4 | 129 |
| Comparative Example 5 | 135 |
| Comparative Example 6 | 124 |
| Comparative Example 7 | 220 |
| Comparative Example 8 | 241 |
| Comparative Example 9 | 165 |

It is clear from Table 3 that by including a cyano compound in the protective layer, the residual potential of the photoreceptor can be decreased. This is because the cyano compound inhibits formation of charge traps.

The cyano compounds used for the hole transport protective layer of the photoreceptor of the present invention does not have a hole transportability and radical reactivity. Therefore, it is considered that increase of the added amount of such a cyano compound deteriorates the hole transportability and mechanical strength of the hole transport protective layer. In contrast, when the added amount becomes too small, the charge trap decreasing effect is hardly produced. Therefore, it is considered that the added amount has a preferable range.

In order to determine the preferable range of the added amount of a cyano compound, an experiment, in which the added amount is changed and the saturated potential and mechanical strength (i.e., elastic deformation rate) of the resultant photoreceptors are measured, was performed.

Example 10

The procedure for preparation of the photoreceptor of Example 4 was repeated except that the cyano compound No. 17 was replaced with the cyano compound No. 20 described above in Table 2 while the added amount was changed from 5% to 0.3% by weight based on the weight of the radically polymerizable hole transport compound.

Thus, a photoreceptor of Example 10 was prepared.

Example 11

The procedure for preparation of the photoreceptor of Example 10 was repeated except that the added amount of the cyano compound No. 20 was changed to 0.5% by weight.

Thus, a photoreceptor of Example 11 was prepared.

Example 12

The procedure for preparation of the photoreceptor of Example 10 was repeated except that the added amount of the cyano compound No. 20 was changed to 1% by weight.

Thus, a photoreceptor of Example 12 was prepared.

Example 13

The procedure for preparation of the photoreceptor of Example 10 was repeated except that the added amount of the cyano compound No. 20 was changed to 5% by weight.

Thus, a photoreceptor of Example 13 was prepared.

Example 14

The procedure for preparation of the photoreceptor of Example 10 was repeated except that the added amount of the cyano compound No. 20 was changed to 10% by weight.

Thus, a photoreceptor of Example 14 was prepared.

Example 15

The procedure for preparation of the photoreceptor of Example 10 was repeated except that the added amount of the cyano compound No. 20 was changed to 15% by weight.

Thus, a photoreceptor of Example 15 was prepared.

The thus prepared photoreceptors of Examples 10-15 and the photoreceptor of Comparative Example 4 prepared above, which does not include the cyano compound, were evaluated with respect to the following properties.

1. Saturated Potential

The evaluation method is described above.

2. Elastic Deformation Rate

Figure 5:
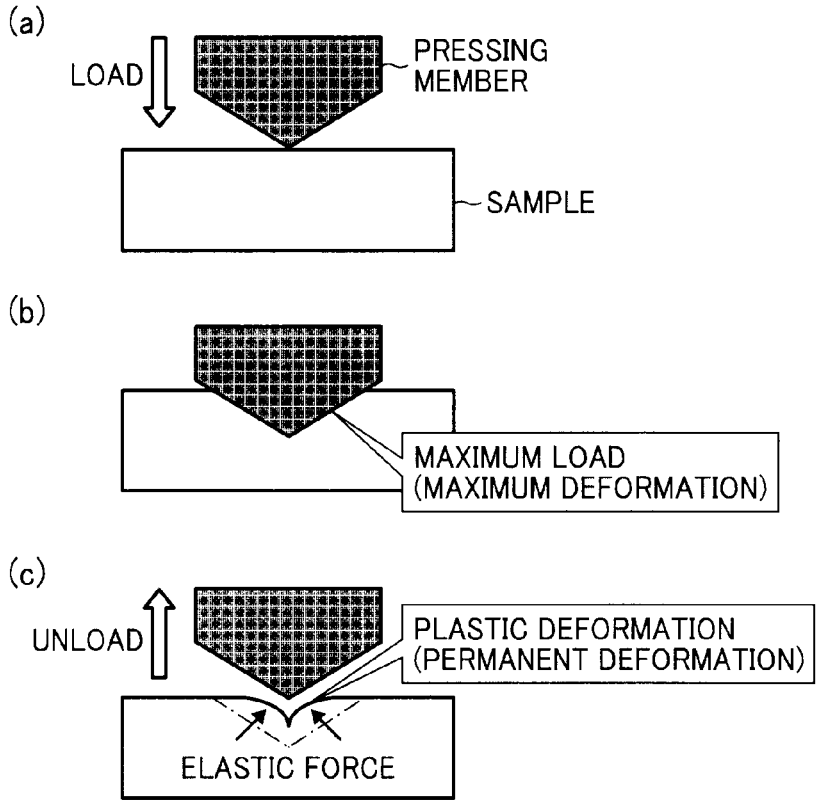
FIG. 5 is a schematic view for explaining the method for measuring the elastic deformation rate of a layer using a micro surface hardness tester.

The method of measuring the elastic deformation rate will be described by reference to FIGS. 5 and 6.

Figure 6:
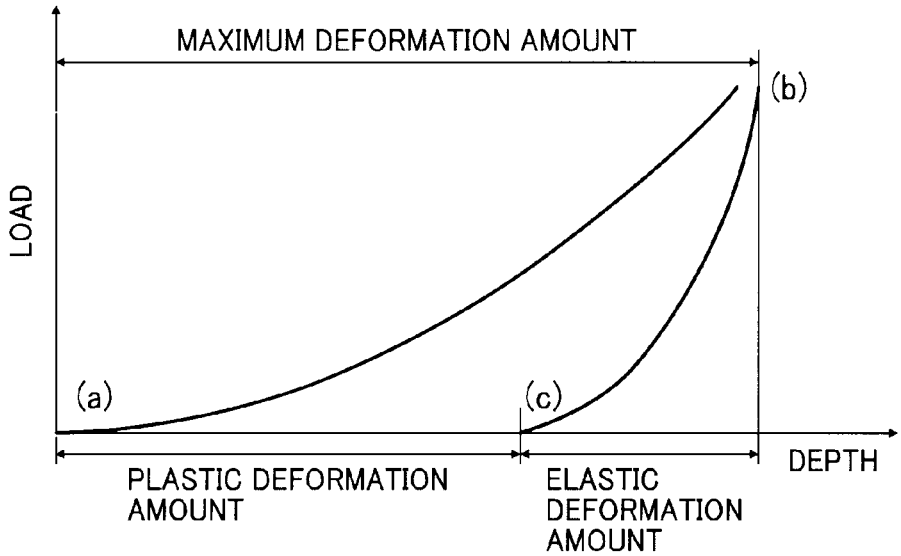
FIG. 6 is a graph showing relation between load to a layer, and plastic deformation amount and elastic deformation amount of the layer.

In this application, the elastic deformation rate (τe) is measured by a loading/unloading test using a micro surface hardness tester having a diamond pressing member. Specifically, as illustrated in FIG. 5, when the pressing member is contacted with a surface of a sample (i.e., photoreceptor) as illustrated in FIG. 5(*a*), the pressing member is pressed to the sample at a constant loading rate (loading process). When the load reaches the predetermined load, the pressing member is stopped for a predetermined time at a maximum deformation point as illustrated in FIG. 5(*b*). Next, the pressing member is drawn up at a constant speed as illustrated in FIG. 5(*c*) (unloading process). In this regard, the point at which the load is not applied to the sample any more is called a plastic deformation point (c) (illustrated in FIG. 6). The relation between the load and the depth of the deformed portion of the sample is illustrated in FIG. 6. The elastic deformation rate (τe) is determined by the following equation:

$$\text{Elastic deformation rate}(\tau e)=[(MD-PD)/MD]\times 100$$

wherein MD represents the maximum deformation amount, and PD represents the plastic deformation amount, which are illustrated in FIG. 6.

The evaluation results are shown in Table 4 below.

TABLE 4

| | Added amount of cyano compound (%) | Saturated potential (−V) | Elastic deformation rate τe (%) |
|---|---|---|---|
| Example 10 | 0.3 | 126 | 44 |
| Example 11 | 0.5 | 101 | 43 |
| Example 12 | 1 | 90 | 42 |
| Example 13 | 5 | 78 | 42 |
| Example 14 | 10 | 73 | 40 |
| Example 15 | 15 | 72 | 33 |
| Comparative Example 4 | 0 | 129 | 45 |

It is clear from Table 4 that the saturated potential depends on the added amount of the cyano compound in a certain range. Specifically, when the added amount is less than 0.5% by weight, the saturation potential is hardly decreased (i.e., the charge trap reducing effect is hardly produced). In addition, even when the added amount is increased so as to be greater than 10% by weight, the saturation potential cannot be decreased any more.

The elastic deformation rate decreases as the added amount of the cyano compound increases. This means that by increasing the added amount of the cyano compound having no radically polymerizable function, the cross-linkage density of the protective layer decreases. When the added amount is not greater than 10% by weight, the resultant photoreceptor can have an elastic deformation rate of not less than 40%, which is much greater than that of a photoreceptor having no protective layer. In this regard, photoreceptors having no protective layer typically have an elastic deformation rate of not less than about 38%. When the added amount is greater than 10% by weight, the elastic deformation rate becomes less than 40%, and the photoreceptor has insufficient mechanical strength.

Therefore, the added amount of a cyano compound is preferably from 0.5% by weight to 10% by weight based on the weight of the radically polymerizable hole transport compound.

Since it was found that addition of a cyano compound can reduce the number of charge traps, an image forming test was performed to determine whether the image qualities are enhanced. Specifically, the photoreceptors of Examples 1-9 and Comparative Examples 1-9 were subjected to the following image forming test.

Each of the photoreceptors was set in a cassette of a digital full color multifunctional product, MP C7500 SP from Ricoh Co., Ltd. After the process cartridge was set to the main body of the multifunctional product, and 500 copies of an A-4-size image having yellow, magenta, cyan and black half-tone stripe images were produced at a speed of 60 cpm and a resolution of 600×600 dpi. The evaluation was performed as follows.

1. In-Plane Image Density Variation

The black images of the first to fifth copies were visually observed to determine whether the image density of each of the half tone black images varies from place to place.

Similarly, the black images of the $496^{th}$ to $500^{th}$ copies were visually observed to determine whether the image density of each of the half tone black images varies from place to place.

The in-plane image density variation property of the photoreceptors was graded as follows.

Grade 5: All the images have no in-plane image density variation.

Grade 4: All the images have little in-plane image density variation.

Grade 3: Some of the images have small in-plane image density variation.

Grade 2: All the images have small in-plane image density variation.

Grade 1: All the images have great in-plane image density variation.

2. Image Density Variation with Time

The image densities of five points of the black half tone image (1×1 dot image) of each of the first and $500^{th}$ copies were measured with a densitometer from Macbeth Co. and averaged to determine the image density variation with time (i.e., difference in image density between the first and $500^{th}$ copies.

The evaluation results are shown in Table 5 below.

TABLE 5

| | In-plane image density variation ($1^{st}$-$4^{th}$ copies) | In-plane image density variation ($496^{th}$-$500^{th}$ copies) | Image density of first copy | Image density of $500^{th}$ copy | Image density difference |
|---|---|---|---|---|---|
| Example 1 | 5 | 4 | 0.452 | 0.442 | 0.010 |
| Example 2 | 5 | 4 | 0.453 | 0.441 | 0.012 |
| Example 3 | 5 | 4 | 0.454 | 0.444 | 0.010 |
| Example 4 | 5 | 5 | 0.458 | 0.446 | 0.012 |
| Example 5 | 5 | 5 | 0.456 | 0.448 | 0.008 |
| Example 6 | 5 | 5 | 0.453 | 0.442 | 0.011 |
| Example 7 | 5 | 4 | 0.459 | 0.450 | 0.009 |
| Example 8 | 5 | 4 | 0.453 | 0.443 | 0.010 |
| Example 9 | 5 | 4 | 0.457 | 0.448 | 0.009 |
| Comp. Ex. 1 | 4 | 3 | 0.458 | 0.433 | 0.025 |
| Comp. Ex. 2 | 4 | 3 | 0.459 | 0.431 | 0.028 |
| Comp. Ex. 3 | 4 | 3 | 0.459 | 0.435 | 0.024 |
| Comp. Ex. 4 | 4 | 3 | 0.455 | 0.430 | 0.025 |
| Comp. Ex. 5 | 4 | 3 | 0.456 | 0.436 | 0.020 |
| Comp. Ex. 6 | 4 | 3 | 0.457 | 0.431 | 0.026 |
| Comp. Ex. 7 | 4 | 3 | 0.453 | 0.435 | 0.018 |
| Comp. Ex. 8 | 4 | 3 | 0.458 | 0.433 | 0.025 |
| Comp. Ex. 9 | 4 | 3 | 0.458 | 0.429 | 0.029 |

It is clear from Table 5 that the photoreceptors of the present invention can produce high quality images with little in-place image density variation and image density variation with time (between the first image and the $500^{th}$ image) even when a large number of copies are continuously produced, and in addition.

It is clear from Tables 4 and 5 that these image qualities depend on presence or absence of a specific cyano compound instead of the value of the saturated potential. Therefore, it is considered that the image qualities depend on the number of charge traps in the protective layer.

Thus, by including such a cyano compound as mentioned above in the protective layer, the number of charge traps therein can be reduced, and thereby the resultant photoreceptor can stably produce such high quality images as to be used for commercial printing.

In the present invention, the main function of the cyano compound included in the hole transport protective layer is to inhibit decomposition of a radically polymerizable hole transport compound in a crosslinking process using high energy rays such as UV rays and electron beams. Since UV absorbents also have such a function, the below-mentioned experiment was performed to compare the effect of a cyano compound with that of UV absorbents.

In addition, cyano compounds are known as electron transport materials. Therefore, the below-mentioned experiment was performed to compare the effect of a cyano compound with that of known electron transfer materials.

Further, the below-mentioned experiment was performed to compare the effect of a cyano compound with the effect of a singlet oxygen quencher Comparative Example 10

The procedure for preparation of the photoreceptor of Example 1 was repeated except that the cyano compound was replaced with an UV absorbent having the following formula UV-1.

(UV-1)

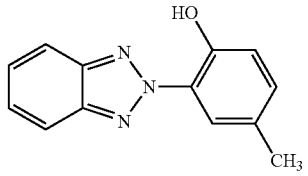

Thus, a photoreceptor of Comparative Example 10 was prepared.

Comparative Example 11

The procedure for preparation of the photoreceptor of Example 1 was repeated except that the cyano compound was replaced with an UV absorbent having the following formula UV-2.

(UV-2)

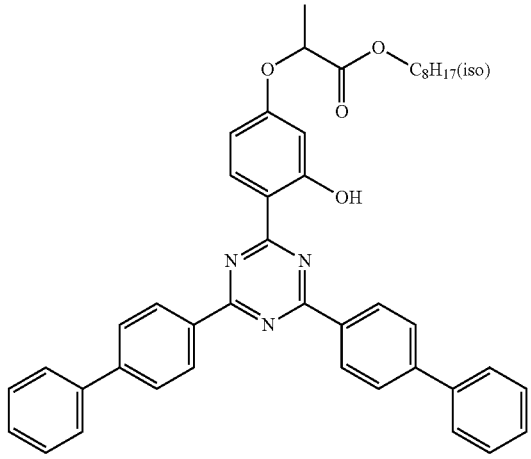

Thus, a photoreceptor of Comparative Example 11 was prepared.

Comparative Example 12

The procedure for preparation of the photoreceptor of Example 1 was repeated except that the cyano compound was replaced with an electron transfer material having the following formula ETM-1.

(ETM-1)

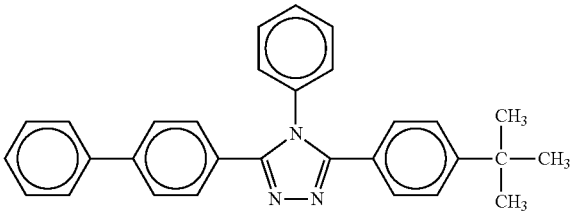

Thus, a photoreceptor of Comparative Example 12 was prepared.

Comparative Example 13

The procedure for preparation of the photoreceptor of Example 1 was repeated except that the cyano compound was replaced with an electron transfer material having the following formula ETM-2.

(ETM-2)

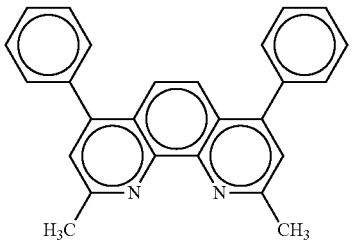

Thus, a photoreceptor of Comparative Example 13 was prepared.

Comparative Example 14

The procedure for preparation of the photoreceptor of Example 1 was repeated except that the cyano compound was replaced with a singlet oxygen quencher having the following formula Q-1.

(Q-1)

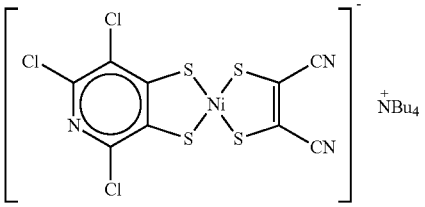

Thus, a photoreceptor of Comparative Example 14 was prepared.

The saturated potential of each of the photoreceptors of Comparative Examples 10-14 was measured to compare the effects of the materials with that of the cyano compounds mentioned above. The results are shown in Table 6 below.

TABLE 6

| | Saturated potential (−V) |
|---|---|
| Comparative Example 10 | 251 |
| Comparative Example 11 | 234 |
| Comparative Example 12 | 222 |
| Comparative Example 13 | 646 |
| Comparative Example 14 | 761 |

It is clear from Table 6 that these materials cannot decrease the saturated potential, and some of the materials increase the saturated potential. Thus, the effect of the cyano compounds mentioned above is remarkable.

Additional modifications and variations of the present invention are possible in light of the above teachings. It is therefore to be understood that within the scope of the appended claims the invention may be practiced other than as specifically described herein.

What is claimed is:

1. An electrophotographic photoreceptor comprising:

an electroconductive substrate;

a charge generation layer located overlying the electroconductive substrate;

a hole transport layer located on the charge generation layer; and a hole transport protective layer located on the hole transport layer, and including an UV or EB crosslinked material including a unit obtained from a radically polymerizable hole transport compound, and a cyano compound (C) having the following formula (1) or (2):

FORMULA (1)

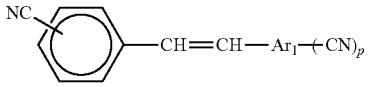

wherein $Ar_1$ represents a mono- or di-valent benzene ring or a mono- or di-valent condensed polycyclic hydrocarbon group having 10 carbon atoms; and p is 0 or 1, and

FORMULA (2)

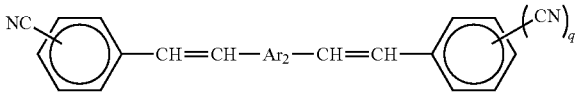

wherein $Ar_2$ represents a di-valent benzene ring or a di-valent condensed polycyclic hydrocarbon group having 10 to 14 carbon atoms; and q is 0 or 1;

wherein the UV or EB crosslinked material is obtained by irradiating a composition including at least the radically polymerizable hole transport compound with ultraviolet rays or electron beams so that the radically polymerizable hole transport compound causes chain polymerization, wherein a weight ratio (C/RHTM) of the cyano compound (C) to the radically polymerizable hole transport compound (RHTM) is from 0.005/1 to 0.1/1.

2. The electrophotographic photoreceptor according to claim 1, wherein the radically polymerizable hole transport compound has an acryloyloxy group or a methacryloyloxy group as a radically polymerizable group.

3. An image forming method comprising:

charging the photoreceptor according to claim 1;

irradiating the charged photoreceptor with light to form an electrostatic latent image thereon;

developing the electrostatic latent image with a developer including a toner to form a toner image thereon; and transferring the toner image onto a recording material.

4. A process cartridge comprising:

the electrophotographic photoreceptor according to claim 1 to bear an electrostatic latent image on a surface thereof; and at least one of a charger to charge the photoreceptor;

a developing device to develop an electrostatic latent image on the surface of the photoreceptor with a developer including a toner to form a toner image thereon;

a transferring device to transfer the toner image onto a recording material;

a cleaner to clean the surface of the photoreceptor after the toner image is transferred; and a discharger to decay residual charges on the surface of the photoreceptor after the toner image is transferred, wherein the electrophotographic photoreceptor and at least one of the charger, the developing device, the transferring device, the cleaner and the discharger are integrated into a single unit so as to be detachably attachable to an image forming apparatus.

* * * * *